US006309691B1

(12) United States Patent
Hasegawa

(10) Patent No.: US 6,309,691 B1
(45) **Date of Patent: *Oct. 30, 2001**

(54) METHOD OF MANUFACTURING ELECTRON-EMITTING DEVICE, ELECTRON SOURCE AND IMAGE-FORMING APPARATUS

(75) Inventor: Mitsutoshi Hasegawa, Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/794,891

(22) Filed: Feb. 5, 1997

(30) Foreign Application Priority Data

Feb. 8, 1996 (JP) ..... 8-045676

(51) Int. Cl.[7] ..... B05D 5/12

(52) U.S. Cl. ..... 427/8; 347/1; 356/237; 427/10; 427/100; 427/121; 427/256; 427/122

(58) Field of Search ..... 347/1; 356/237; 427/8, 10, 121, 58, 256, 100, 122, 140, 287

(56) References Cited

U.S. PATENT DOCUMENTS

| | | | | |
|---|---|---|---|---|
| 3,611,077 | | 10/1971 | Smith | 315/94 |
| 4,627,730 | * | 12/1986 | Jungerman et al. | 356/349 |
| 5,286,414 | * | 2/1994 | Kampf et al. | 427/58 X |
| 5,486,701 | * | 1/1996 | Norton et al. | 356/382 X |

FOREIGN PATENT DOCUMENTS

| | | |
|---|---|---|
| 0 604 939 | 7/1994 | (EP) . |
| 0 605 881 | 7/1994 | (EP) . |
| 0 658 912 | 6/1995 | (EP) . |
| 717428A2 | 6/1996 | (EP) . |
| 59-211936 | 11/1984 | (JP) . |
| 61-104541 | 5/1986 | (JP) . |
| 61-296649 | 12/1986 | (JP) . |
| 7235255 | 9/1995 | (JP) . |
| 8273529 | 1/1996 | (JP) . |

* cited by examiner

*Primary Examiner*—Shrive P. Beck
(74) *Attorney, Agent, or Firm*—Fitzpatrick, Cella, Harper & Scinto

(57) ABSTRACT

An electron-emitting device having an electroconductive film including an electron-emitting region arranged between a pair of device electrodes is manufactured. The electroconductive film is formed by applying a liquid containing the material of the film to a substrate by using an ink-jet method, then drying and heating the applied liquid. Defective conditions, if any, in the applied liquid or the precursor film formed by drying the liquid or the electroconductive film formed by heating the precursor film are detected and remedied by applying the same liquid again to the area detected for a defective condition. The detection and remedy of any defective condition may be conducted after the liquid-applying, drying or baking step.

28 Claims, 15 Drawing Sheets

METHOD OF MANUFACTURING ELECTRON-EMITTING DEVICE, ELECTRON SOURCE AND IMAGE-FORMING APPARATUS

BACKGROUND OF THE INVENTION

1. Field of the Invention

This invention relates to a method of manufacturing an electron-emitting device having an electroconductive film, an electron source realized by arranging a plurality of such electron-emitting devices on a substrate and an image-forming apparatus comprising the same.

2. Related Background Art

CRTs have been widely used for image-forming apparatus for displaying images by means of electron beams.

In recent years, on the other hand, flat panel display apparatus utilizing liquid crystal have been replacing CRTs to some extent. However, they are accompanied by certain drawbacks including that they have to be provided with a back light because they are not emissive and hence there exists a strong demand for emissive type display apparatus. While plasma displays have become commercially available as emissive-type display apparatus, they are based on principles that are different from those of CRTs and cannot fully compete with CRTs, at least currently, from the viewpoint of contrast, chromatic effects and other technological factors. Since an electron-emitting device appears to be very promising for preparing an electron source by arranging a plurality of such devices and an image-forming apparatus comprising such an electron source is expected to be as effective as CRTS for light emitting effects, efforts have been made in the field of research and development of such electron-emitting devices.

For instance, the applicant of the present invention has made a number of proposals for an electron source realized by arranging a number of surface conduction electron-emitting devices that are cold-cathode type devices and an image-forming apparatus comprising such an electron source.

Since the configuration and the characteristic features of a surface conduction electron-emitting device and those of an electron source comprising such devices are described in detail in various documents, including Japanese Application Laid-Open No. 7-235255, they will be described only summarily here. FIGS. 4A and 4B of the accompanying drawings schematically illustrate a surface conduction electron-emitting device comprising a substrate 1, a pair of device electrodes 2 and 3 and an electroconductive film 4, which includes an electron-emitting region 5. With a method of producing an electron-emitting region, a part of the electroconductive film is deformed, transformed or destroyed to make it electrically highly resistive by applying a voltage between the paired device electrodes. This process is referred to as "energization forming process". In order to produce an electron-emitting region that operates well for electron emission in an electroconductive film, the latter preferably comprises electroconductive fine particles such as fine particles of palladium oxide (PdO). A pulse voltage is preferably used for an energization forming process. A pulse voltage to be used for energization forming may have a constant wave height as shown in FIG. 13A or, alternatively, it may have a gradually increasing wave height as shown in FIG. 13B.

While an electroconductive film of fine particles may be prepared by means of a gas deposition technique, with which electroconductive fine particles are deposited directly on a substrate, a technique of applying a solution of a compound of the element that constitutes the electroconductive film (e.g., an organic metal compound) to a substrate and producing a desired electroconductive film, typically by heat treatment, is more advantageous particularly for preparing a large electron source because it does not require the use of a vacuum apparatus and hence is less costly. For applying a solution of an organic metal compound only to an intended area, an ink-jet device may advantageously be used because it does not require any additional patterning operation for the electroconductive film.

After producing an electron-emitting region, a film containing carbon as a principal ingredient is formed by deposition in the electron-emitting region and its vicinity, to increase the intensity of electric current flowing through the device and improve the electron-emitting property of the device a pulse voltage is applied between the device electrodes in an appropriate atmosphere containing organic substances (a process referred to as "activation process").

Then, the electron-emitting device is preferably subjected to a process referred to as "stabilization process", where the device is placed into and heated in a vacuum vessel, while the latter is gradually evacuated, in order to satisfactorily remove the organic substances remaining in the vacuum vessel and make the device operate stably.

Methods for producing electroconductive films for an electron source comprising surface conduction electron-emitting devices are disclosed in a number of documents including Japanese Patent Application Laid-Open No. 8-273529, the assignee of which is the applicant of the present patent application.

Now, ink-jet devices that can be used for the purpose of the present invention will be briefly described below.

Ink-jet devices are roughly classified into two types according to the ink ejection technique used in the device.

According to a first ink ejection technique, fine liquid drops of ink are ejected by the pressure generated by contraction of a piezo-electric element arranged in a nozzle. A second technique is referred to as a bubble-jet system, with which ink is heated to a bubble by means of a heat-generating resistor and then ejected in the form of fine liquid drops.

FIGS. 5 and 6 schematically illustrate ink-jet devices of these two types.

FIG. 5 shows a piezo-jet type ink-jet device comprising a first glass-made nozzle 21, a second glass-made nozzle 22, a cylindrical piezo-electric element 23, tubes 25 and 26 for feeding liquid to be ejected, that may typically be a solution of an organic metal compound, and an electric signal input terminal 27. As a predetermined voltage is applied to the electric signal input terminal, the cylindrical piezo-electric element contracts to discharge the liquid staying there as fine drops.

FIG. 6 shows a bubble-jet type ink-jet device comprising a base plate 31, a heat-generating resistor 32, a support plate 33, a liquid path 34, a first nozzle 35, a second nozzle 36, a partition wall 37, a pair of liquid chambers 38 and 39 containing a predetermined liquid, a pair of liquid supply ports 310 and 311 and a top plate 312. With this arrangement, the liquid in the liquid chambers is caused to bubble and forced out from the nozzles as liquid drops by the heat generated by the heat-generating resistor. While each of the above-described devices has a pair of nozzles, the number of nozzles arranged in a device of the type under consideration is not limited to two.

After applying a solution of an organic metal compound only to predetermined areas as fine liquid drops by means of an ink-jet device of either of the above-described types and then drying the solution, the organic metal compound is heated for pyrolysis to produce an electroconductive film typically made of fine particles of metal or metal oxide.

The resulting electroconductive film has a thickness preferably between several and 50 nanometers, although it may vary depending on the electric resistance of the electroconductive film, the distance separating the device electrodes and other factors.

The variance of the film thickness has to be strictly limited within a single electron-emitting device and also among the electron-emitting devices of an electron source.

An electron-emitting region may not be prepared correctly and properly in an electron-emitting device if the electroconductive film of the electron-emitting device shows a large variance. Likewise, an electron source comprising a large number of electron-emitting devices showing a large variance in the film thickness of their electroconductive films may not operate evenly and uniformly for electron emission.

Therefore, the ink-jet device to be used for producing electroconductive films has to be examined and regulated thoroughly in order to ensure an even and uniform production of electroconductive films that are free from any undesirable variance in the film thickness.

A large and high definition flat-type image-forming apparatus can be manufactured only by using an electron source comprising a large number of electron-emitting devices that operate satisfactorily from the above described point of view.

Thus, while the ink-jet device being used for forming electroconductive films on respective electron-emitting devices is rigorously controlled for operation in order to avoid producing defective devices, the probability of producing defective devices inevitably rises as the number of electron-emitting devices arranged in an image-forming apparatus increases.

There can be various causes that give rise to defective electroconductive films produced by means of an ink-jet device, including noise mingled into the electric signals for controlling the ink-jet device that interfere with the normal liquid drop ejecting operation of the device to make the film thickness of the produced electroconductive film significantly depart from a predetermined level, mechanical vibrations that displace the locations where liquid drops are applied on the electron source substrate, and foreign objects put into the liquid contained in the ink-jet device to interfere with the normal liquid discharge of the device to make the electroconductive films unacceptable in terms of thickness, location and profile.

When manufacturing electron-emitting devices on a mass production basis, it is very difficult to improve the rate of producing acceptable devices or the manufacturing yield particularly when a large number of electron-emitting devices have to be produced on a single substrate.

A high manufacturing yield is accompanied by high manufacturing cost and a need for treating rejected devices. In view of the current social need for suppressing the volume of industrial waste, therefore, there is a strong and urgent demand for a method of manufacturing electron-emitting devices at a high yield.

SUMMARY OF THE INVENTION

Under the above-described circumstances, it is therefore an object of the present invention to provide a method of manufacturing an electron-emitting device such as an surface conduction electron-emitting device having an electroconductive film including an electron-emitting region that can be used for rectifying a rejected electroconductive film to an acceptable one in the course of manufacturing the device.

Another object of the present invention is to provide a method of manufacturing an electron source comprising a plurality of electron-emitting devices that can remarkably improve the manufacturing yield by partially rectifying defective electroconductive films found in the devices in the course of manufacturing the electron source.

Still another object of the present invention is to provide a method of manufacturing an image-forming apparatus comprising an electron source prepared by arranging a large number of electron-emitting devices that can effectively and remarkably improve the manufacturing yield and produce image-forming apparatus that are free from defective images and a noticeable variance in the brightness.

According to an aspect of the invention, the above object is achieved by providing a method of manufacturing an electron-emitting device having an electroconductive film including an electron-emitting region arranged between a pair of device electrodes, characterized in that the process of forming an electroconductive film including an electron-emitting region comprises steps of applying a liquid containing the material of the electroconductive film to a substrate by an ink-jet method and thereafter detecting any defective condition in the applied liquid and applying the liquid containing the material again to the detected defective area in the applied liquid by an ink-jet method.

According to another aspect of the invention, there is provided a method of manufacturing an electron source comprising a plurality of electron-emitting devices arranged on a substrate, each having an electroconductive film including an electron-emitting region formed between a pair of device electrodes, characterized in that the electron-emitting devices are manufactured by the above-described method.

According to still another aspect of the invention, there is also provided a method of manufacturing an image-forming apparatus comprising an electron source formed by arranging a plurality of electron-emitting devices on a substrate, each having an electroconductive film including an electron-emitting region formed between a pair of device electrodes, and an image-forming section for forming an image by irradiation of electrons emitted from the electron source, characterized in that the electron-emitting devices are manufactured by the above-described method.

DETAILED DESCRIPTION OF THE PREFERRED EMBODIMENTS

Now, the present invention will be described in greater detail by referring to the accompanying drawings that illustrate preferred embodiments of the invention.

In one aspect, the present invention specifically relates to a method of manufacturing an electron source comprising a large number of electron-emitting devices arranged on a substrate, each having a pair of device electrodes oppositely disposed on the substrate and an electroconductive film connected to the paired device electrodes and including an electron-emitting region as part thereof, wherein the process of forming the electroconductive film for each electron-emitting device comprises steps of applying drops of a liquid containing the material of the electroconductive film to a predetermined area of a substrate by an ink-jet device and drying. Thereafter the applied liquid is heat-treated to produce a film of electroconductive fine particles. Furthermore there are the following additional steps.

In a first preferred mode of carrying out the invention, the additional steps are steps of examining a precursor film for forming a film of electroconductive fine particles (hereinafter simply referred to as "precursor film") produced as a result of the step of applying drops of the liquid by an ink-jet device, removing the film from the area determined to be defective as a result of the examining step and applying drops of the liquid again to the removed area. Now, these steps will be described by referring to FIGS. 1A through 1E.

Figure 1A:
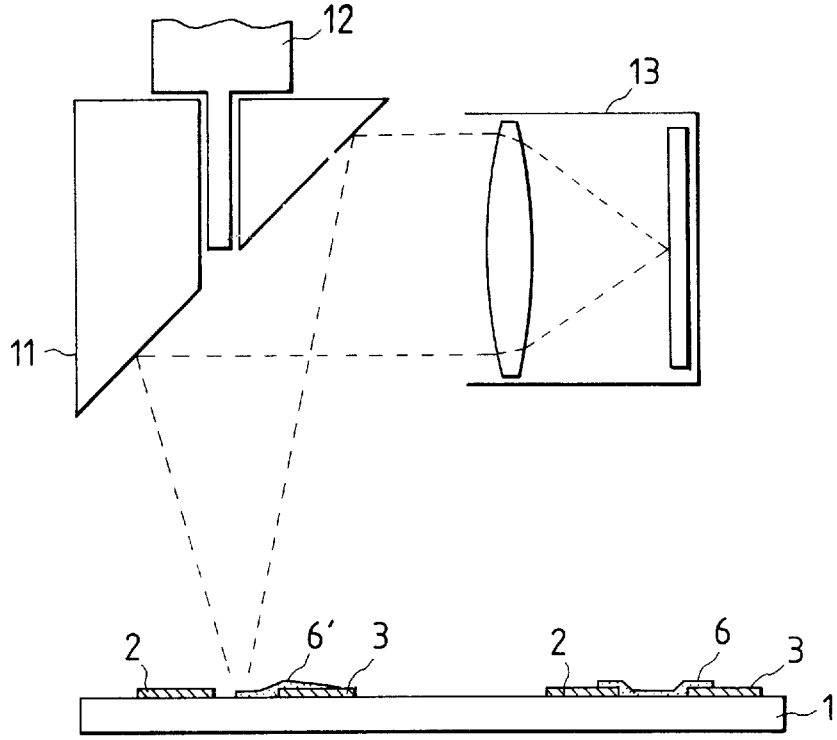
FIGS. 1A, 1B, 1C, 1D and 1E are schematic illustrations of a method of manufacturing an electron-emitting device according to the invention, showing steps of examining a precursor film, removing a defective precursor film and forming a replacement precursor film.

Referring firstly to FIG. 1A, there are shown a substrate 1 for forming an electron source and a pair of device electrodes 2 and 3. Then, a precursor film 6 is formed between the paired device electrodes to electrically connect them. If the produced precursor film is displaced from its proper position, it is rectified by the above described method. More specifically, reference symbol 6' denotes a displaced precursor film that has to be rectified. Techniques that can be used for detecting abnormal conditions on the precursor film such as displacement include visual observation through an optical microscope. FIG. 1A also illustrates an arrangement for detecting abnormal conditions. Referring to FIG. 1A, there are shown a reflector 11, an ink-jet device 12 for discharging a solvent for rectification and an imaging apparatus 13 including an image enlarging optical system. With such an arrangement, any defective precursor film can be detected and the solvent can be applied there for rectification, while the ink-jet device can be checked for proper positioning by means of the imaging apparatus at the same time. Any abnormal conditions including a defective profile and an abnormal film thickness of the precursor film and unusually large crystal grains of the metal compound that is the precursor of the electroconductive material of the electroconductive film can be detected along with any positional displacement of the precursor film by this detecting operation. A precursor film under such an abnormal condition is determined to be defective for the purpose of the invention.

Various techniques may be used for removing defective films.

With a first technique, the film formed by applying a solvent such as water or an organic solvent by means of an ink-jet device is expanded through dissolution and dilution. Although the film should not be expanded to get to any of the adjacently arranged devices, this technique can prove to be simple and effective if the device of the film is separated from the adjacent devices by a considerable space and the fine particles of the film are dispersed when dried and heat-treated so that it can be expanded sufficiently to make it electrically unconductive if viewed globally.

Figure 1B:
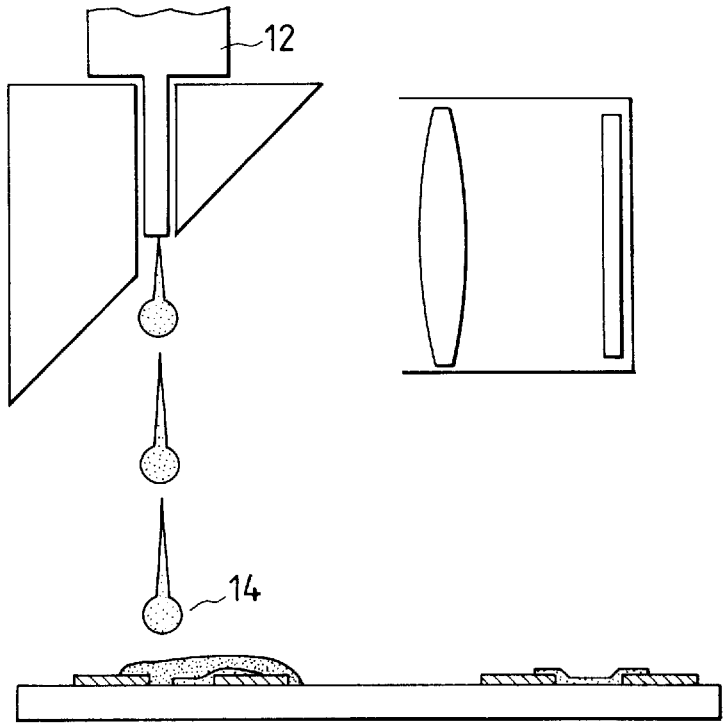
Figure 1C:
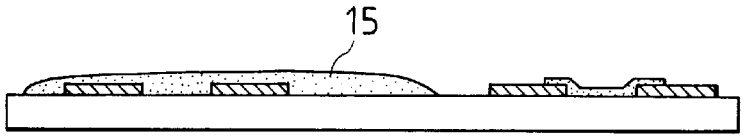
Figure 1D:
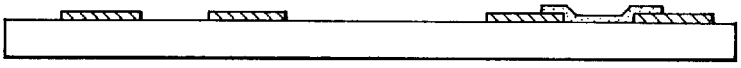
Figure 1E:
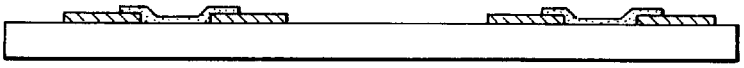

The above-described technique of removing a film will be described further by referring to FIGS. 1B through 1D. Firstly, drops 14 of the solvent are applied to the precursor film to be rectified as shown in FIG. 1B. Then, the puddle 15 of the solvent formed on the precursor film is expanded without allowing it to get to any of the adjacently located electron-emitting devices. When the solvent is dried, the amount of the remaining organic metal compound is negligible and, as shown in FIG. 1D, the profile of the device before the formation of the precursor film is substantially restored. With a method according to the invention, a precursor film is formed once again as shown in FIG. 1E after the defective one is removed through the above-described steps.

Now, the relationship between the film thickness and the sheet resistance of the film of electroconductive fine particles will be discussed.

When an electroconductive thin film that can be used for the purpose of the invention is made of a material having a resistivity ρ and has a width w, a length l and a thickness t, the sheet resistance Rs of the film is used to define the electric resistance R of the film as determined between the longitudinal opposite ends of the film.

$$R=Rs\cdot l/w$$

If ρ and t are constant and do not have positional dependency, the sheet resistance Rs is expressed by the equation below.

$$Rs=\rho/t$$

Thus, Rs is inversely proportional to t if the average film thickness is sufficiently greater than the average diameter of the fine particles of the film. This is because the film of fine particles can be approximately regarded to be an evenly and continuously extending film for various calculations and the positional variance of the film thickness that may be small does not have any significance for the purpose of the invention.

However, if the average film thickness is approximately the same as the average diameter of the fine particles of the film, the sheet resistance of the film is significantly affected by the local unevenness of the film. This is because the film is made of fine particles and the positional variance of the film thickness becomes significant relative to the average film thickness to make the sheet resistance greater than the value obtained by extrapolating the above relationship of inversely proportional to the film thickness.

As the average film thickness is reduced further, the resistance shows a sharp rise until the film becomes totally unconductive if viewed globally because the fine particles of the film do not contact each other in considerable portions thereof. Under this condition, clusters, each formed by a single fine particle or by a plurality of fine particles, become isolated as they do not connect with each other. It may not be appropriate to call it a "film" any more under such a condition but will nevertheless be called as such hereinafter for the sake of convenience if such a way of naming may not give rise to any misunderstanding.

Figure 14:
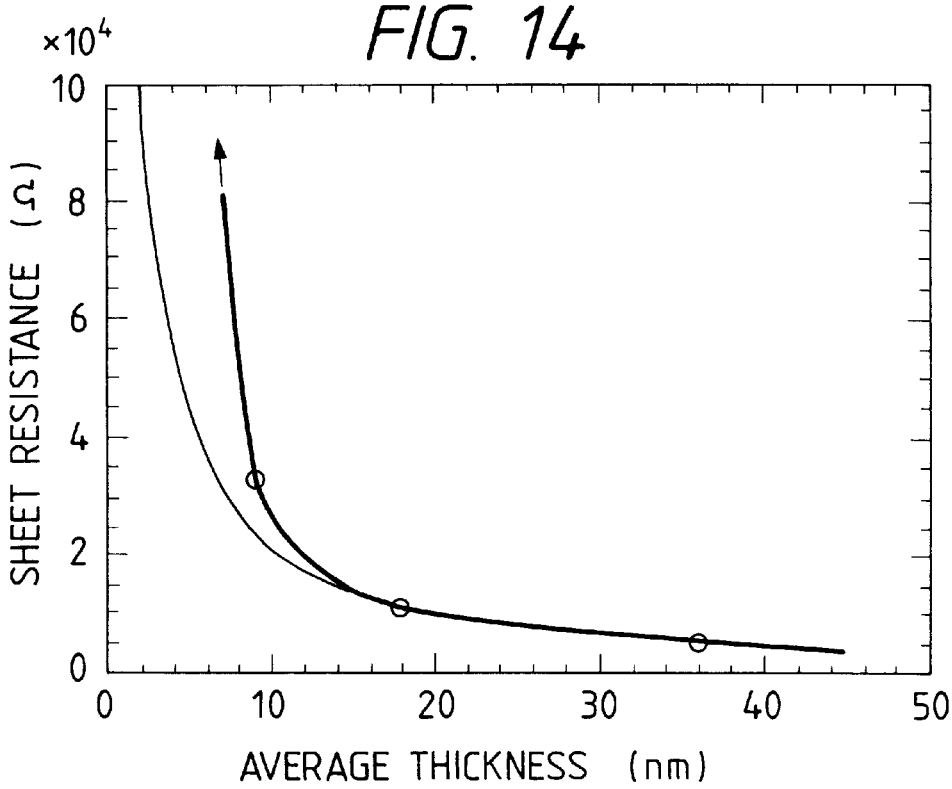
FIG. 14 is a graph showing the relationship between the film thickness and the sheet resistance of a film of electroconductive fine particles.

FIG. 14 is a graph showing the relationship between the film thickness and the sheet resistance of a film of fine particles of palladium oxide (PdO) produced by using an aqueous solution of an organic palladium compound as will be described hereinafter by referring to Example 1-1 and other examples. In any of these examples, the film thickness was controlled by controlling the number of times of applying drops of the aqueous solution of the organic palladium compound or by further applying drops of water to the applied drops of the aqueous solution to expand the area occupied by the applied drops of the aqueous solution. The applied organic palladium compound was then turned to palladium oxide (PdO) by heat-treating it at 300° C. for 12 minutes. In any specimen used in the examples, the palladium oxide (PdO) fine particles showed an average particle diameter of 10±2 nm. It was also found that the sheet resistance Rs was inversely proportional to the film thickness t when the average film thickness was greater than about 15 nm but the actual values (indicated by the thick solid line in FIG. 14) became greater than the calculated values (indicated by the thin solid line in FIG. 14) obtained by extrapolating the above relationship when the average film thickness was almost as large as the average particle diameter. The sheet resistance of the film showed an abrupt rise to lose its electric conductivity when the film thickness became as small as 6 nm. Therefore, the results of the examples as described hereinafter agree well with the above observation.

Thus, what is important for carrying out the present invention is apparently to determine the extent to which the precursor film is expanded. If the electroconductive film obtained by heat-treating a normal precursor film has a film thickness of t and a surface area of s and the precursor film is expanded to show an area of S by applying a solvent in an above described rectifying operation, the average thickness T of the "film" (which is in fact not a film) produced by the subsequent heat-treatment will be expressed by T=st/S. In order for the film not to globally show any electric conductivity, T has to be sufficiently smaller than the average particle diameter D of the fine particles of the film. More specifically, T is preferably smaller than 60% of D.

The operation of applying drops of the solution for the second time may be conducted when the solvent applied in the above step is dried or after the normal precursor film is heat-treated to produce an electroconductive film. If drops of the solution are applied after a heat-treatment operation of the precursor film, the precursor film that is diluted and expanded by the applied solvent in the above step will become comprised of isolated fine particles and the solution will wet the substrate in a way same as it did when it was applied for the first time to make the rectified device operate properly like a device that operates well from the very beginning. If the device is locally exposed to a reducing gas to turn the electroconductive fine particles of the metal oxide into those of the pure metal, the fine particles will be coagulated further to increase their diameters and successfully make the film unconductive globally even when the expansion of the area of the precursor film by the application of the solvent is more or less restricted.

The film may be made more apt to dissolve in the solvent if the latter contains an appropriate ligand. In other words, an aqueous solution of a salt containing a ligand that can easily coordinate with the metal atom of the metal compound constituting the precursor film can easily dissolve the precursor film. Preferably, a chelatable ligand is used for the above ligand for the purpose of the invention. Candidates for such a ligand include diamines, amino acids and dicarboxylic acids.

Figure 2A:
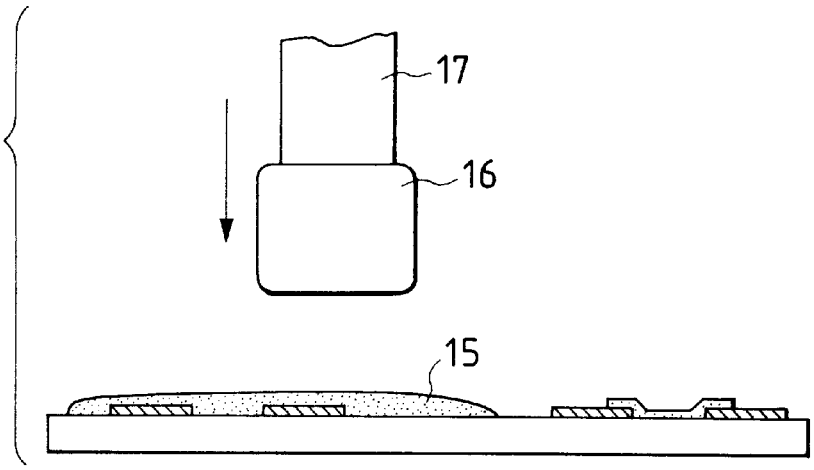
FIGS. 2A, 2B and 2C are schematic illustrations of a method of manufacturing an electron-emitting device according to the invention, showing an alternative step of removing a defective precursor film.

With a second technique for removing defective precursor films, after diluting the film with a solvent as with the above-described first technique (FIG. 2A), the solvent is sucked and removed from the film. The operation of sucking the solvent can be carried out by means of a spongy piece of porous resin 16 fitted to the front end of a rod 17 as shown in FIG. 17 or alternatively by means of a syringe needle or a tube. The device shows the original profile as shown in FIG. 23 after removing the solution dissolving the precursor film so that another precursor film may be formed there. With this technique, electron-emitting devices may be arranged more densely than the case where the above-described first technique is used. In other words, this technique is suited in cases where the puddle of the solvent cannot be sufficiently expanded and the first technique is not feasible.

In a second preferred mode of carrying out the invention, the additional steps are steps of examining the eletroconductive films produced by heat-treating the liquid drops applied by an ink-jet device, removing the electroconductive films judged as defective in the examining step and applying liquid drops to the appropriate areas of the removed defective films and heat-treating them to produce replacing electroconductive films.

An optical microscope may be used for optically observing electroconductive films in the examining step. Alternatively, the electroconductive films may be examined by observing the electric resistance of each of the electron-emitting devices and this examining technique may work more sensitively than the optical observation technique for detecting any abnormal film thickness.

Since the electroconductive film is not soluble in the solvent at this stage, the technique of diluting the electroconductive film as described earlier by referring to the first mode of carrying out the invention cannot feasibly be used here. Thus, a technique of physically removing the electroconductive film is adopted in this second mode of carrying out the invention. For instance, a fine rod carrying a piece of a soft and adhesive substance such as silicon rubber may be used and pressed onto the electroconductive film to make it adhere to the silicon rubber in order to remove it.

Figure 7:
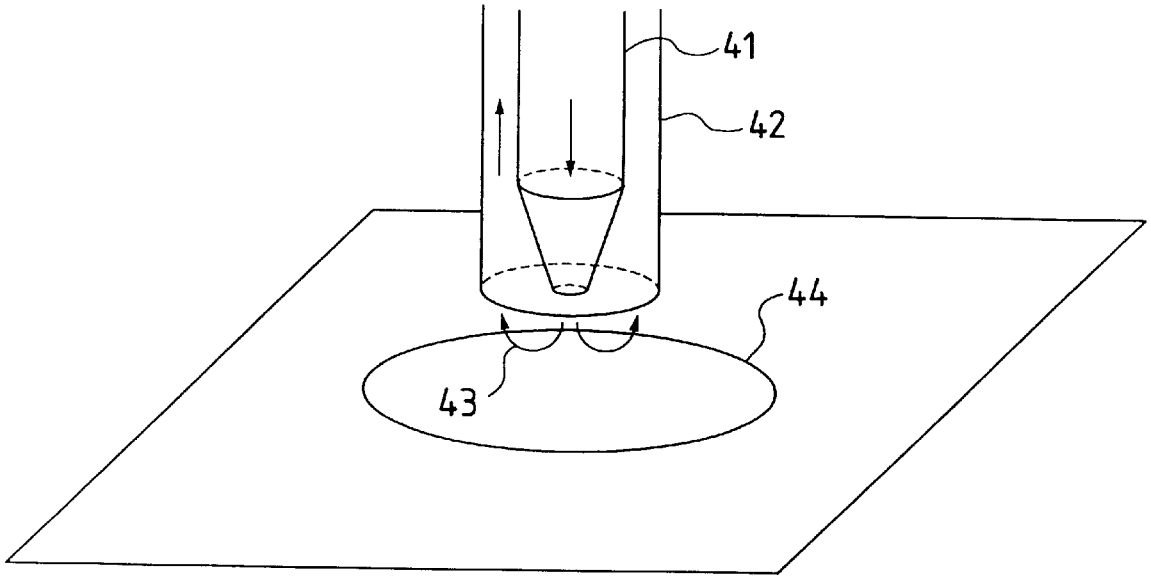
FIG. 7 is a schematic illustration of a device for locally producing a reducing atmosphere.

The electroconductive film can be removed reliably if the electroconductive film is made less adherent to the substrate. More specifically, if the electroconductive film is made of fine particle of an electrically conductive metal oxide, the adhesion of the electroconductive film can be reduced by chemically reducing the metal oxide to pure metal. If, for example, the electroconductive film is made of fine particle of palladium oxide (PdO), the oxide can easily be reduced to metal Pd by exposing it to a hydrogen containing atmosphere. While the reducing reaction may proceed at room temperature, it may be made to proceed more quickly if the electroconductive film is heated to about 150° C. The use of a dual nozzle structure as shown in FIG. 7 may appropriately be used for exposing only selected devices to reducing gas. The inner nozzle 41 of the dual nozzle structure is used to eject reducing gas, which is then sucked by the outer nozzle 42 of the dual nozzle structure. If the outer nozzle is made to suck reducing gas at a rate sufficiently greater that the rate at which gas is discharged from the inner nozzle, the flow 42 of reducing gas would not be dispersed and gas will flow only through an area close to the nozzle tip to produce a local reducing atmosphere. With such an arrangement, an electroconductive film 44 to be removed can be exposed to the local reducing atmosphere to reduce its adhesion to the substrate so that it may be removed without difficulty. A mixture gas containing hydrogen is preferably used as reducing gas to which a film of fine particles of palladium oxide (PdO) is exposed. Alternatively, the reducing gas containing hydrogen may advantageously be diluted with inert gas such as rare gas or nitrogen gas to realize a hydrogen concentration of 1 to 2% because such a mixture gas is free from the risk of explosion because the hydrogen concentration is sufficiently low and hence no specific anti-explosion arrangement is required for the purpose of the present invention.

In a third preferred mode of carrying out the invention, the additional steps are steps of examining the electroconductive film on each of the electron-emitting devices formed on a substrate after applying drops of a solution of the material of the electroconductive film by means of an ink-jet device to produce the electroconductive film and carrying out an energization forming process to produce an electron-emitting region there with or without a subsequent activation process and forming an electroconductive film on each of the devices determined to be defective in the examining step by applying liquid drops there once again by means of the ink-jet device. If necessary, the electroconductive film may be removed prior to the step of applying liquid drops.

The above-described activation process is a process of applying a pulse voltage between the device electrodes of each of the electron-emitting devices formed on a substrate in an appropriate atmosphere containing an organic substance after producing an electron-emitting region in the electroconductive film of the device to produce a film of a deposit containing carbon as principal ingredient on and near the electron-emitting region in order to increase the electric current that flows through the device and improve the electron-emitting performance of the device.

As described above, while an optical microscope may be used for the examining step, each of the devices can be examined by causing an electric current to flow through the device and observing the relationship (If–Vf relationship) between the voltage (device voltage) Vf applied to the device and the electric current (device current) If flowing through the device.

If the If–Vf relationship is observed for each of the electron-emitting devices in an examining step conducted after the completion of the activation process, a triangular pulse voltage to be used for driving the device in an ordinary operation of the electron source may be applied to it. A defective electron-emitting device may easily be detected if it shows an unusually large electric resistance or the device electrodes are short-circuited. A leak current in the device may also easily be detected because the If–Vf relationship is ohmically affected. Otherwise, the device may show a deviation of the threshold voltage of the If–Vf relationship from a normal value for many reasons, which can also be detected and identified.

If the examining step is conducted before the activation process by applying a voltage to be used for driving the device in an ordinary operation of the electron source, the value of If is very low and the fissure in the electron-emitting region can be broadened to adversely affect the electron-emitting performance of the device. However, since the device shows a non-linear I-V relationship with a threshold voltage sufficiently lower than the voltage causing the broadening of the fissure, the device may be judged to be acceptable if the threshold voltage is found within a given range and unacceptable if the voltage is not found within that range.

More specifically, a triangular pulse voltage slightly higher than the threshold voltage is applied to each of the devices of the electron source to see the I-V relationship of the device. As described above, any short circuiting between the device electrodes and a leak current existing in the device can be detected from the observed I-V relationship.

Figure 3A:
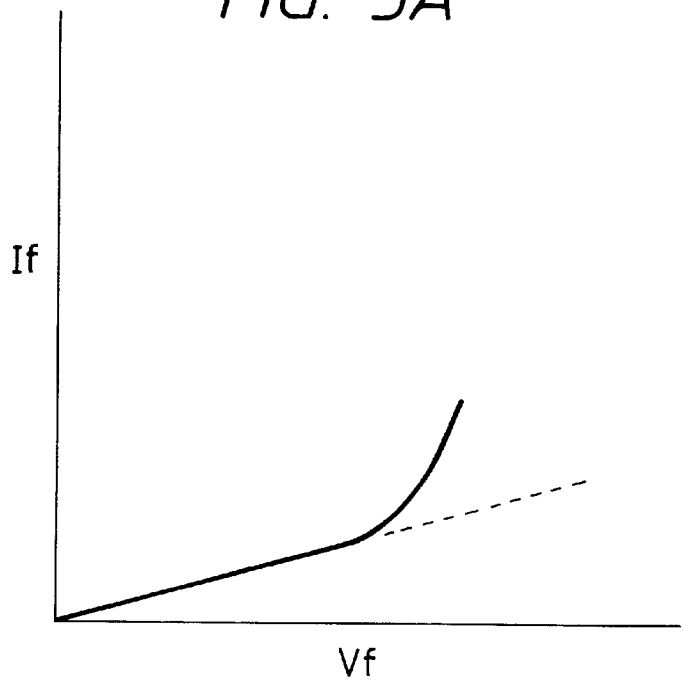
FIG. 3A is a graph showing the If–Vf relationship of an electron-emitting device accompanied by a leak current as a result of an energization forming process.
Figure 3B:
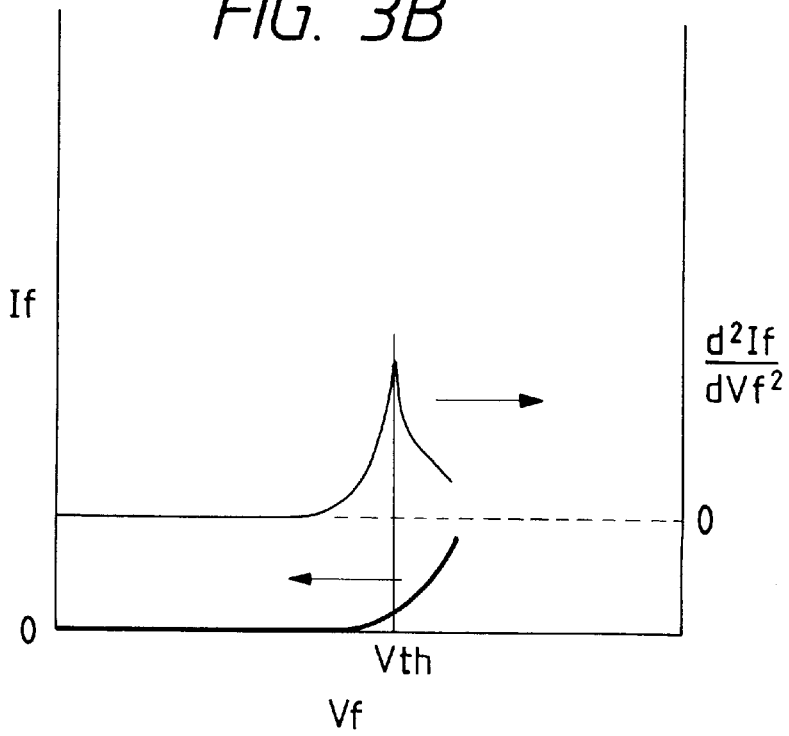
FIG. 3B is a graph showing the If–Vf relationship of an electron-emitting device properly subjected to an energization forming process.
Figure 4A:
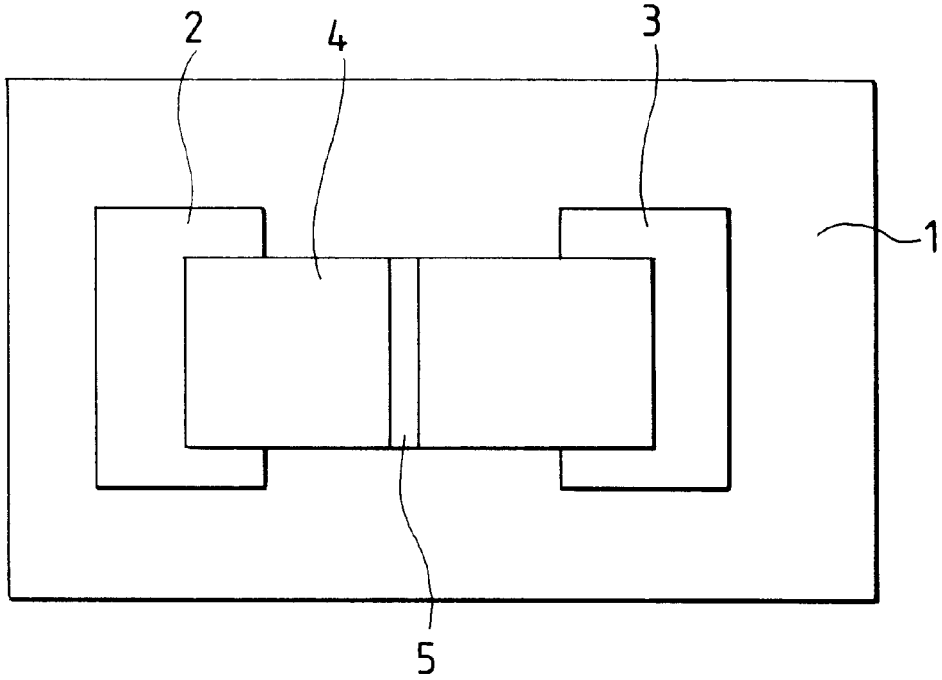
FIGS. 4A and 4B are schematic illustrations of a surface conduction electron-emitting device, showing its configuration.
Figure 4B:
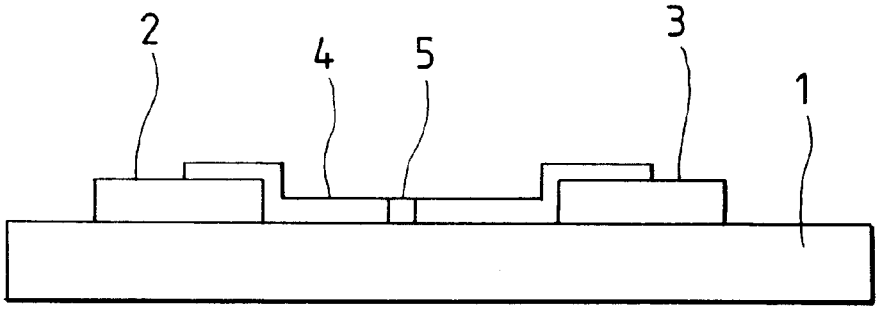

Additionally the quadratic differential of the If–Vf relationship is determined by calculation using the obtained data to find a peak value, which is taken for the threshold voltage and used to determine if the device is acceptable or not. Care should be taken to use data that are substantially free from noise for the calculation of determining the quadratic differential. If necessary, the observation should be repeated and the average of the observed values should be used to minimize the influence of noise. FIG. 3A shows a graph of the If–Vf relationship that is ohmically affected. It may be safe to assume that a leak current is flowing through the device that shows such a relationship. To the contrary, FIG. 3B shows a graph of the If–Vf relationship that is normal and also a graph of the values calculated for $d^2If/dVf^2-Vf$. The voltage Vth corresponding to the obtained peak value of the quadratic differential is used as the threshold voltage and the device is judged to be acceptable if the threshold voltage is found within a given range. Thus, while a sophisticated testing apparatus has to be used for determining the If–Vf relationship before the activation process, this technique is recommended if it is expected that the operation of producing a second electroconductive film may have to be conducted frequently, because it is free from the disadvantage of carrying out the activation process twice.

The step of removing the electroconductive film from each of the electron-emitting devices that is determined to be defective in terms of short-circuiting and leak current is indispensable for the purpose of the invention. However, the electroconductive film does not necessarily need to be removed literally in this step if the fissure of the electron-emitting region has been unusually broadened for a reason or another, which may be an excessive electric current used in the energization forming process. If such is the case, liquid drops of the solution may simply be applied to the site of the electroconductive film to produce another electroconductive film, which is subsequently subjected to an energization forming process.

Note that the second and third techniques may be used not only when a solution of a compound of the substance of the electroconductive film is applied by an ink-jet device but also when a solution containing dispersed electroconductive fine particles for forming the electroconductive film is used.

If the above-described third technique is used, the activation process may be carried out either before or after assembling the image-forming apparatus unless the examining step is conducted after the activation process. If the activation process takes place after assembling the image-forming apparatus, an appropriate organic gaseous substance is placed in the vacuum container of the image-forming apparatus and a pulse voltage is applied repeatedly to the electron-emitting devices of the apparatus for the activation process. If, on the contrary, the activation process is conducted before assembling the image-forming apparatus, the electron source of the apparatus is placed in an appropriate vacuum apparatus with an appropriate gaseous substance and a pulse voltage is applied repeatedly to the electron-emitting devices of the apparatus.

The former procedure has an advantage in that it does not require any additional vacuum apparatus, whereas the latter provides an advantage that no organic substance for the activation process has to be introduced into the vacuum container of the image-forming apparatus. Hence, the organic substance already existing in the vacuum container, if any, can easily be removed to stabilize the operation of the apparatus. Either of the above two procedures may be selected for the activation process by taking the actual manufacturing conditions into consideration.

Organic substances that can be used for the activation process include acetone and n-hexane. Alternatively, an exhausting device that is not oil-free may be used to exploit the organic substance produced by the device.

It will be needless to say that the latter procedure is necessarily used when the examining step is conducted by means of the third technique after the activation process.

The present invention includes a method of manufacturing a flat-type image-forming apparatus comprising an electron source prepared by means of one of the above-described first through third techniques.

EXAMPLES

Now, the present invention will be described further by way of examples.

Example 1-1

In this example, an electron source was prepared by following the steps as described below by referring to FIGS. 8A through 8E.

(Step-a)

Figure 8A:
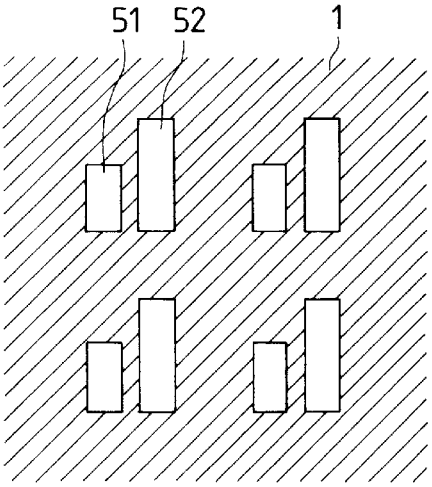
FIGS. 8A, 8B, 8C, 8D and 8E are schematic illustrations of a process of forming an electron source with a matrix-wiring arrangement.

After thoroughly cleansing a soda lime glass plate a silicon oxide ($SiO_2$) film was formed thereon to a thickness of 0.5 $\mu$m by sputtering to produce a substrate 1, on which a resist layer is formed by applying photoresist (AZ1370: available from Hoechst Corporation) onto the substrate by means of a spinner. Thereafter, the photoresist was exposed to light and photochemically developed to produce a pair of openings corresponding to the contours of the device electrodes of each electron-emitting device to be formed on the substrate. Thereafter, Ti and Pt were sequentially deposited to respective thicknesses of 5 nm and 50 nm by sputtering and then the resist layer was removed with an organic solvent to produce device electrodes 51 and 52 for each electron-emitting device by means of a lift-off technique. (FIG. 8A)

(Step-b)

Figure 8B:
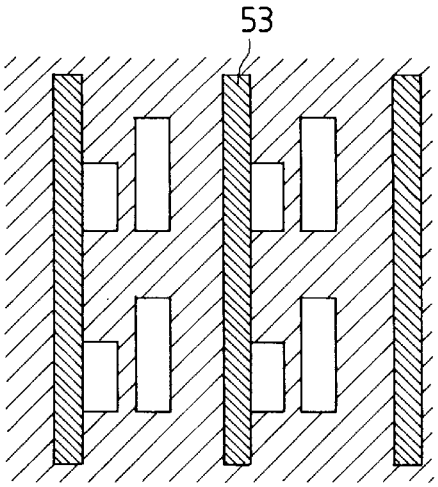

A predetermined pattern of Ag paste was formed by screen printing and baked to produce Y-directional wires 53, each having a thickness of about 20 $\mu$m and a width of 100 $\mu$m. (FIG. 8B).

(Step-c)

Figure 8C:
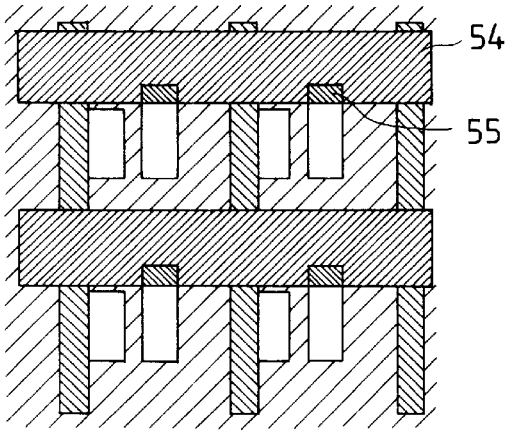

A predetermined pattern of glass paste was formed by printing and baked to produce an interlayer insulation layer 54 for the devices of each row. Note that a cutout area 55 was formed for each device electrode 52 so that the latter was not covered by the interlayer insulation layer, which showed a width of about 250 $\mu$m and a thickness of about 20 $\mu$m in areas where it was laid on the Y-directional wires and about 35 $\mu$m in the remaining areas. (FIG. 8C)

(Step-d)

Figure 8D:
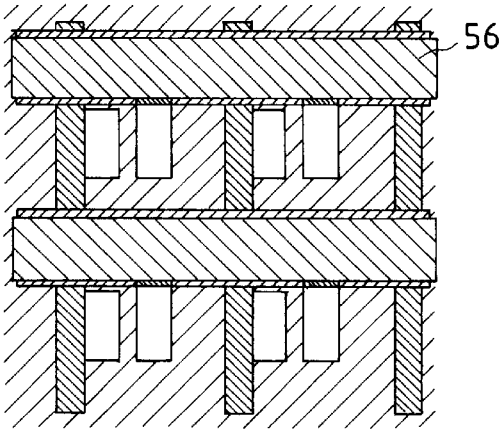
Figure 8E:
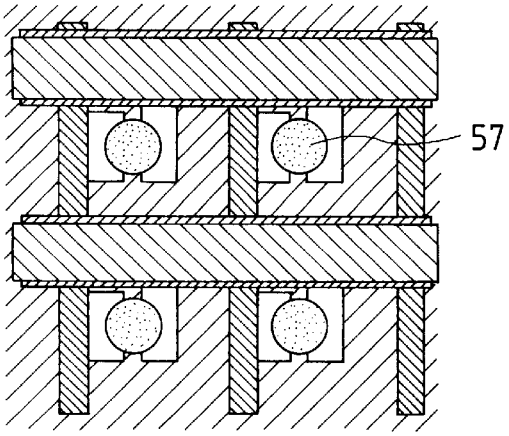

A predetermined pattern of Ag paste was formed on the interlayer insulation layer 54 and baked to produce X-directional wires 56, each having a width of about 200 $\mu$m and a thickness of 15 $\mu$m. (FIG. 8D)

(Step-e)

Figure 5:
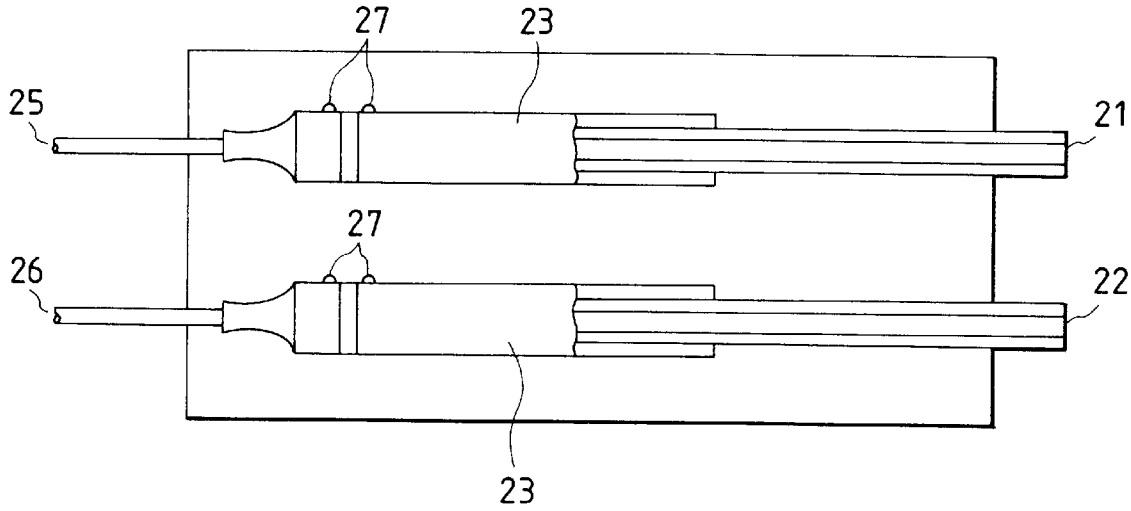
FIG. 5 is a schematic illustration of a piezo-jet type ink-jet device, showing its configuration.

Subsequently, drops of a solution of a complex of an organic palladium compound and an ethanol amine were applied to each electron-emitting device by means of a piezo-jet type ink-jet device to produce a precursor film 57 for the electroconductive film of the device. Any adjacently located ones of the produced X-directional wires were separated by about 350 $\mu$m, whereas any adjacently located ones of the Y-directional wires were separated by about 270 $\mu$m. The precursor film had a substantially circular contour with a diameter of about 48 $\mu$m. Drops of the solution were applied in such a manner that the produced precursor film showed a film thickness of about 15 nm after a heat-treatment process, which will be described hereinafter. The precursor film contained fine particles with a diameter of about 10 nm after the heat-treatment process conducted under the conditions as will be described hereinafter. (FIG. 8E) FIG. 5 schematically illustrates an ink-jet device similar to the one used in this step, although only one of the paired nozzles was used for forming the precursor film.

(Step-f)

Each of the precursor films was observed by means of an image processing technique using a microscope and an optical sensor to automatically determine if the film is acceptable or not. Any film that carried one or more than one large crystals, that had been displaced from the proper position, that had been deformed and did not show a proper circular form or that had a diameter exceeding 48 $\mu$m or smaller than 32 $\mu$m was determined to be unacceptable and drops of butyl acetate were applied to the defective area by means of the ink-jet device, using the nozzle that had not been used in the Step-e above. The ink-jet device was so regulated for the discharge of the solution that each drop showed a volume of about 60 $\mu m^3$ and a total of ten drops were applied to each defective device to dissolve and dilute the defective precursor film in order to expand the film over the entire area surrounded by wires. Then, the solvent of butyl acetate was held to 120° C. for 10 minutes for drying. As a result, the precursor film expanded to show an area about 13.5 times as large as the original area. Thus, the palladium oxide "film" obtained by heat-treating the film showed an average film thickness of about 1 nm, which was sufficiently smaller than the average diameter of the fine particles of about 10 nm. In other words, the precursor film expanded by the solvent did not significantly affect the subsequent steps.

(Step-g)

A precursor film was formed again on the area, from which the precursor film had been removed in the above step, under the conditions as described above for Step-e. The precursor film was observed through an microscope to confirm that it was acceptable this time.

(Step-h)

Then, the precursor film was heat-treated at 300° C. for 10 minutes to produce an electroconductive film comprising fine particles of PdO.

(Step-i)

Figure 9:
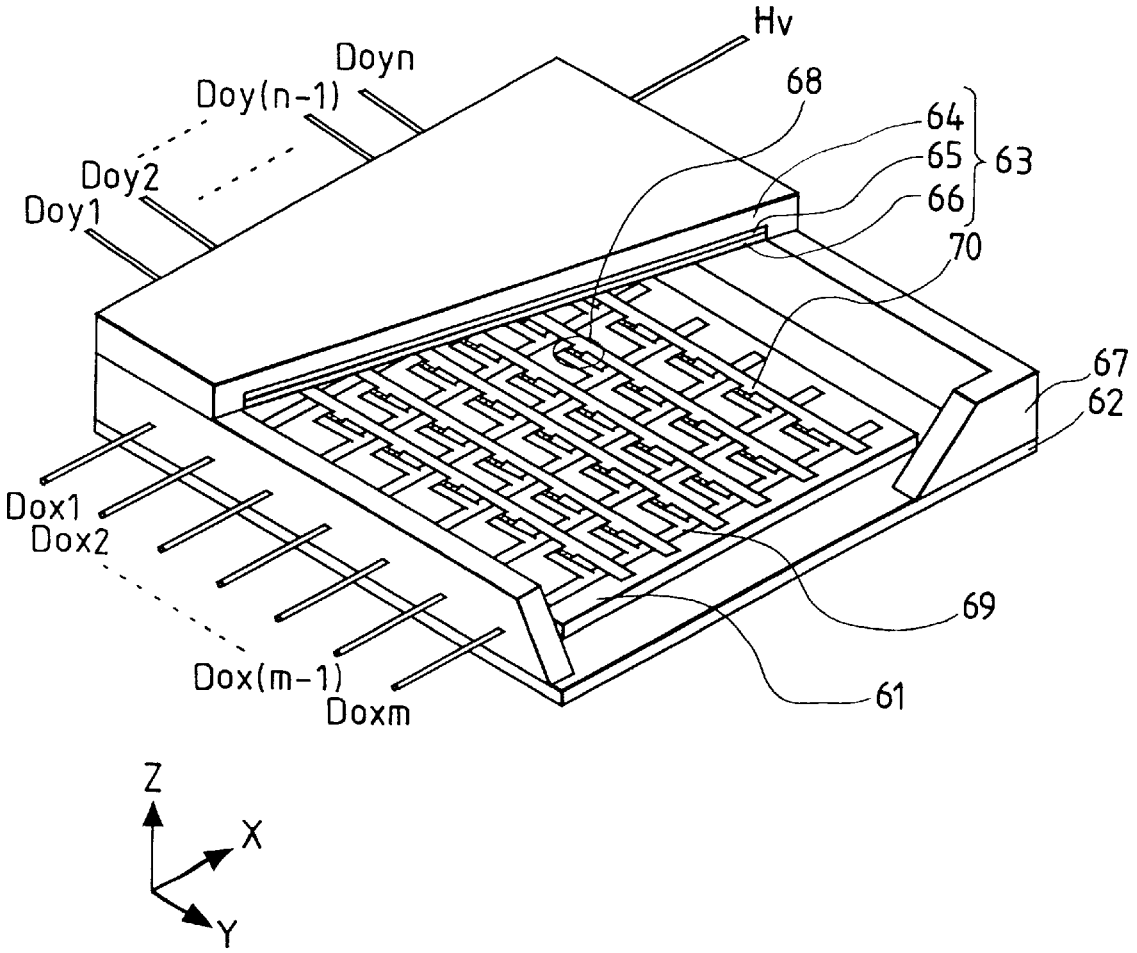
FIG. 9 is a schematic illustration of an image-forming apparatus manufactured by a method according to the invention.

Then, the prepared electron source substrate (carrying thereon a plurality of pairs of device electrodes and electroconductive films arranged between the respective pairs of device electrodes) was used to produce an image-forming apparatus having a configuration as schematically illustrated in FIG. 9. After securing the electron source substrate 61 onto a rear plate 62 by means of frit glass, a face plate 63 (carrying a fluorescent film 65 and a metal back 66 arranged on the inner surface of a glass substrate 64) was arranged with a support frame 67 disposed therebetween and, subsequently, frit glass was applied to the contact areas of the face plate 63, the support frame 67 and the rear plate 62 and baked at 400° C. in the atmosphere for 10 minutes to hermetically seal the container. In FIG. 9, reference numeral 68 denotes an electron-emitting device and numerals 69 and 70 respectively denote an X-directional device wire and a Y-directional device wire.

While the fluorescent film 65 consists only of a fluorescent body if the apparatus is for black and white images, the fluorescent film 65 of this example was prepared by forming black stripes in the first place and filling the gaps separating them with stripe-shaped fluorescent members of primary colors. The black stripes were made of a popular material containing graphite as a principal ingredient. A slurry technique was used for applying fluorescent materials onto the glass substrate 64.

A metal back 66 is typically arranged on the inner surface of the fluorescent film 65. After preparing the fluorescent film 65, the metal back 66 was prepared by carrying out a smoothing operation (normally referred to as "filming") on the inner surface of the fluorescent film 65 and thereafter forming thereon an aluminum layer by vacuum evaporation.

While a transparent electrode may be arranged on the face plate 63 on the outside of the fluorescent film 65 in order to enhance the electroconductivity of the fluorescent film 65, no such transparent electrode was used in this example because the metal back provided a sufficient electroconductivity.

For the above bonding operation, the components were carefully aligned in order to ensure an accurate positional correspondence between the color fluorescent members 122 and the electron-emitting devices.

(Step-j)

Figure 10:
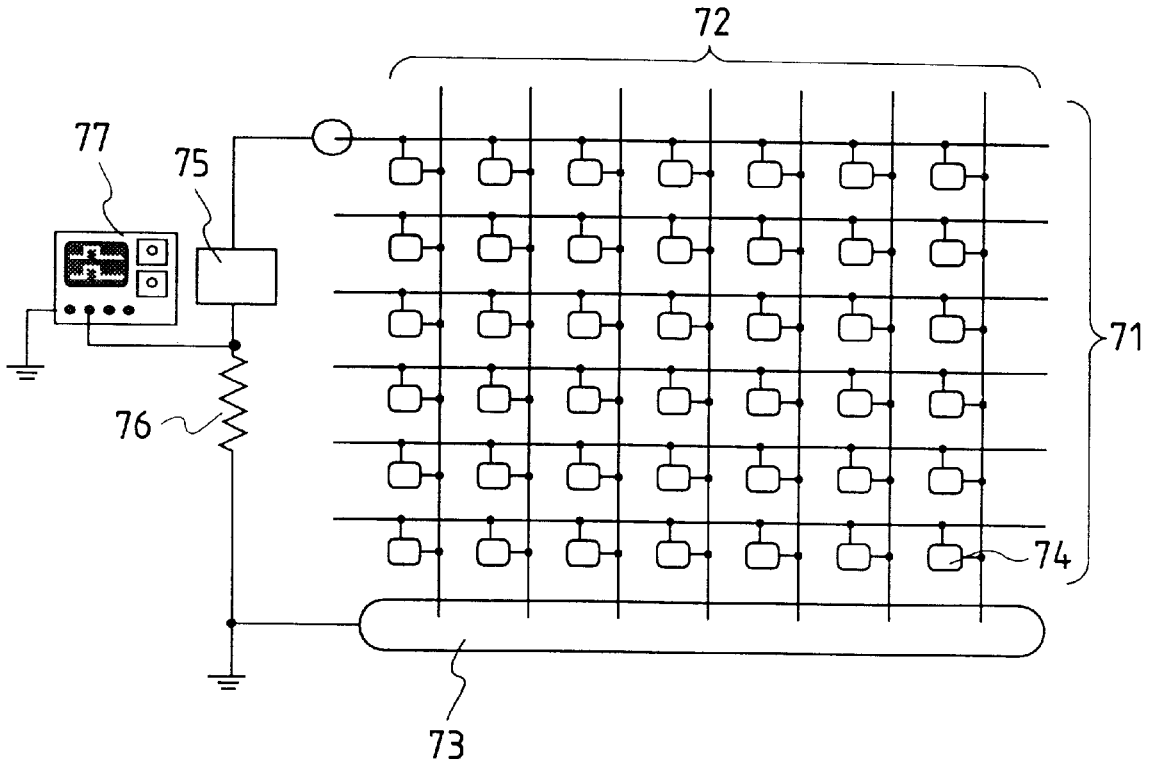
FIG. 10 is a schematic illustration of a wiring arrangement to be used for an energization forming process.

The prepared glass container (hereinafter referred to as "envelope") was then evacuated by way of an exhaust pipe (not shown) to reduce the internal pressure to less than $1.3\times10^{-4}$Pa, when an energization forming process was conducted in a manner as described hereinafter to produce an electron-emitting region in each of said plurality of electroconductive films. In the energization forming process, the Y-directional wires were connected to a common electrode 73 and applied to a voltage to the X-directional wires on a one-by-one basis as shown in FIG. 10. In FIG. 10, reference numerals 71 and 72 respectively denote X- and Y-directional wires, of which the Y-directional wires 72 are connected to the ground by way of a common electrode 73. An electron-emitting device 74 is arranged at each of the crossings of the X- and Y-directional wires. Reference numeral 75 denotes a pulse generator whose anode is connected to one of the X-directional wires while its cathode is connected to the ground by way of a resistor 76 for measuring the current intensity. Reference numeral 77 in FIG. 10 denotes an oscilloscope for monitoring the pulse current used for energization forming.

Figure 13A:
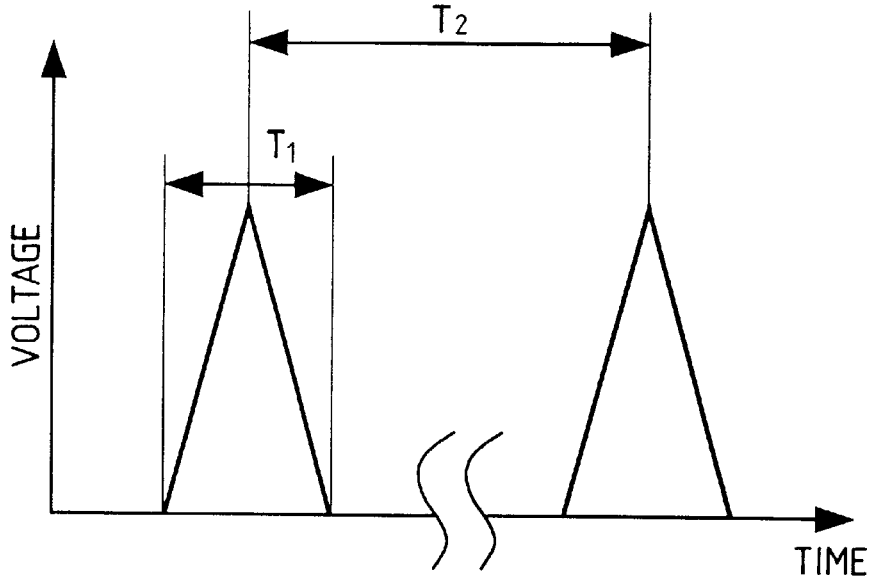
FIGS. 13A and 13B are graphs showing two different pulse voltage waveforms that can be used for an energization forming process for the purpose of the invention.
Figure 13B:
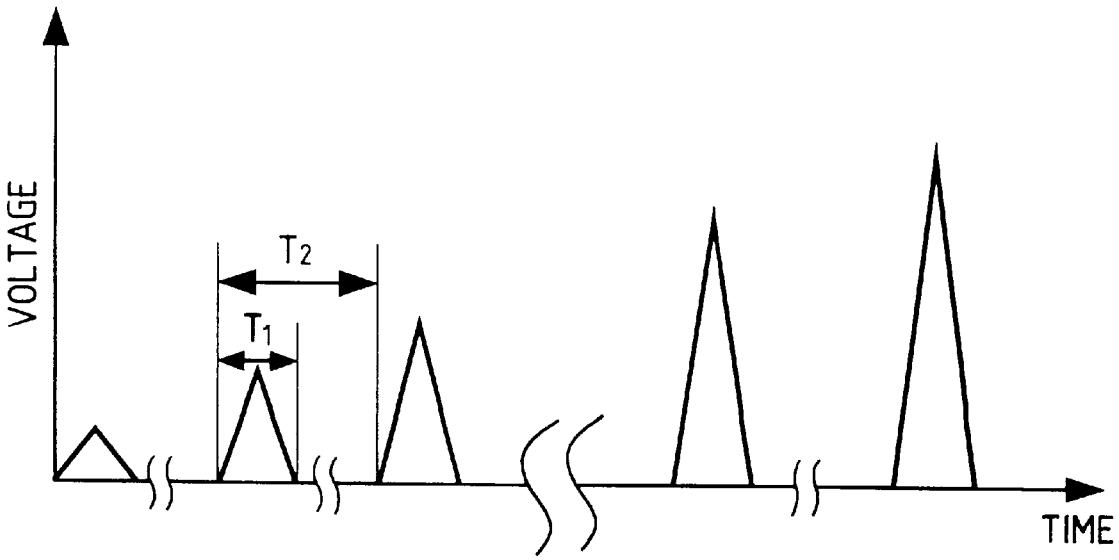

A voltage having a waveform was shown in FIG. 13B was used for the energization forming process.

Referring to FIG. 13B, the applied voltage was a triangular pulse voltage having a pulse width of T1=1 msec and a pulse interval of T2=10 msec and the wave height (the peak voltage for energization forming) was gradually raised with a step of 0.1V. During the energization forming process, an extra pulse voltage of 0.1V was inserted into intervals of the energization forming pulse voltage in order to determine the resistance of the electron-emitting devices and the energization forming process was terminated when the resistance per device exceeded 100 kΩ.

(Step-k)

Subsequently, acetone was introduced into the envelope to produce a pressure of $1.3\times10^{-2}$Pa in the inside of the envelope. Then, an activation process was carried out by applying a pulse voltage. The applied pulse voltage was a rectangular waveform having a wave height of 18V.

(Step-l)

The inside of the envelope was evacuated for 10 hours to reduce the internal pressure to about $1.3\times10^{-6}$Pa, while maintaining the temperature of the entire envelope to 200° C.

After confirming that the apparatus operated properly for displaying images by matrix drive, the exhaust pipe (not shown) was welded by heating it with a gas burner to hermetically seal the envelope.

Finally, the envelope was subjected to a gettering process by means of high frequency heating.

The produced image-forming apparatus operated excellently for displaying images without noticeable unevenness in the brightness.

Example 1-2

The image-forming apparatus prepared in this example was same as that of Example 1-1 except that the plurality of electron-emitting devices were wired in a different way. More specifically, a ladder-like wiring arrangement was used for this example.

In this example, pairs of wires 95-*a* and 95-*b* were arranged on a substrate 91 and a plurality of paired device electrodes having respective electroconductive films prepared in a manner as described by referring to Example 1-1 were arranged between and connected to the wires and the substrate 91 was then put in an envelope provided with grid electrodes 96 having apertures 97 for allowing electrons to pass therethrough to produce an image-forming apparatus as in the case of Example 1-1. The image-forming apparatus operated as effectively as that of Example 1-1. Note that the components in FIG. 16 that are same as or similar to their counterparts of FIG. 9 are denoted by the same respective reference numerals.

Example 2

In this example, an image-forming apparatus was prepared by using the method of Example 1-1 except for the following.

Figure 6:
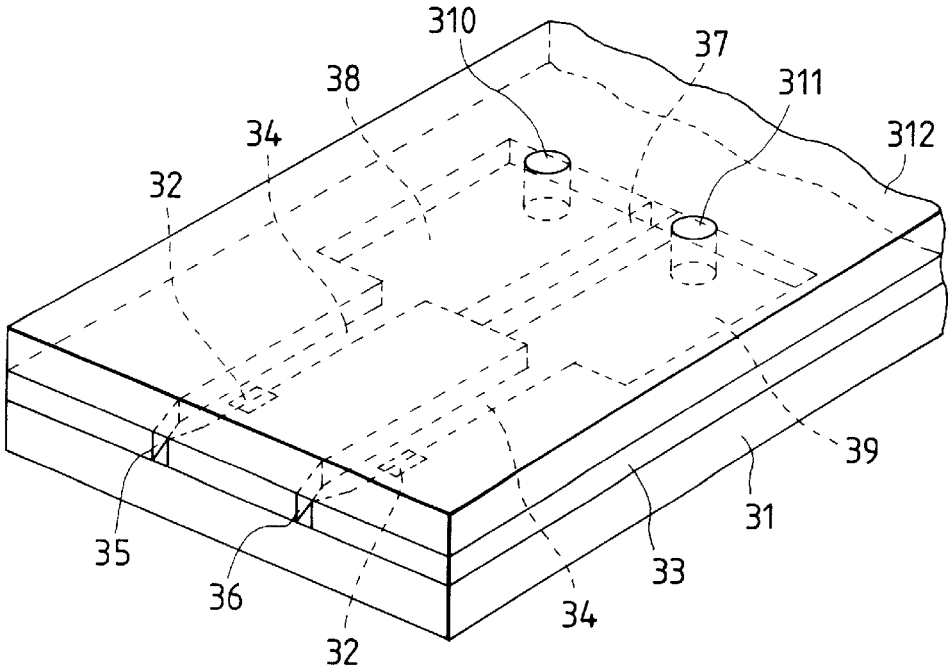
FIG. 6 is a schematic illustration of a bubble-jet type ink-jet device, showing its configuration.

A bubble-jet type ink-jet device was used for applying liquid drops as described in Step-e of Example 1-1. The ink-jet device had a configuration as shown in FIG. 6. In this example, one of the nozzles 35 and 36 was used for applying drops of an organic palladium solution, which solution was prepared by dissolving palladium acetate-monoethanole amine (PAME) into water to make the solution contain metal by 1 wt %.

Additionally, drops of water were applied to the precursor films that had been judged as unacceptable in Step-f of Example 1-1 in order to dissolve the films. Drops of water were applied through the nozzle not used in Step-e.

The resulting image-forming apparatus operated excellently for displaying images without noticeable unevenness in the brightness as in the case of Example 1-1.

Note that an aqueous solution of palladium acetate may also be used for this example.

Similarly, butyl acetate may be used as solvent for dissolving defective precursor films as in the case of Example 1-1. The volume of liquid drops to be applied may be halved if the number of times of liquid drop application is doubled to produce a same effect. The above-described procedures may also be used for preparing an electron source having a ladder-like wiring arrangement described in Example 1-2.

Example 3-1

Figure 11A:
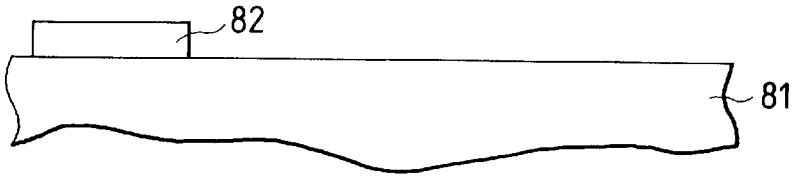
FIGS. 11A, 11B, 11C, 11D and 11E are schematic illustrations of part of an electron source being processed for wiring by means of photolithography for the purpose of the invention.
Figure 11B:
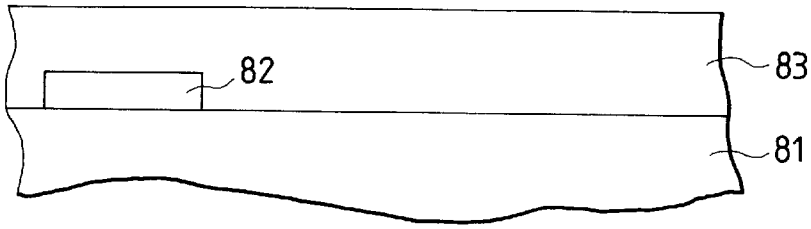
Figure 11C:
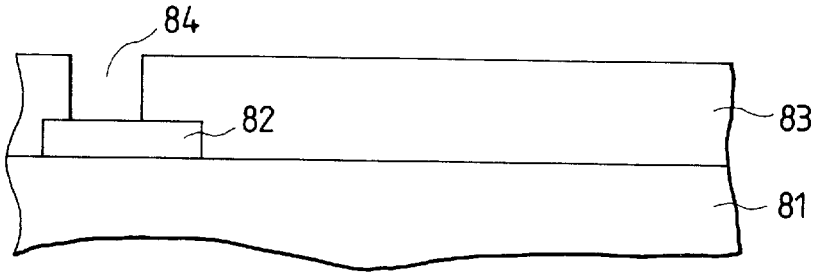
Figure 11D:
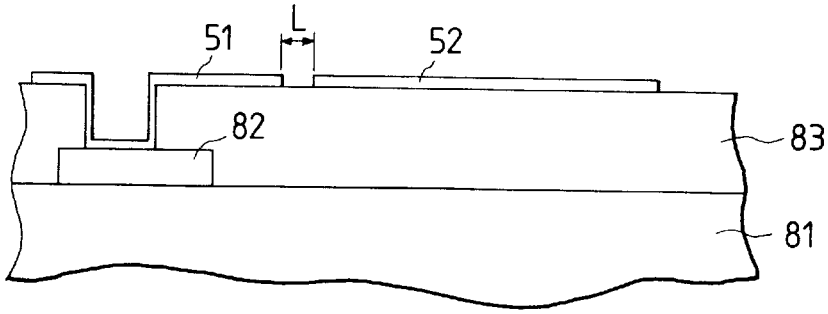
Figure 11E:
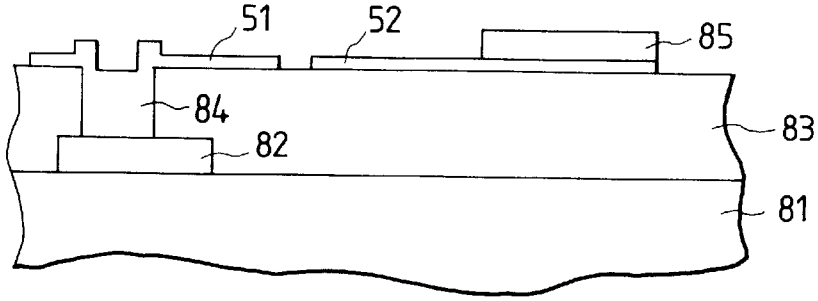
Figure 12:
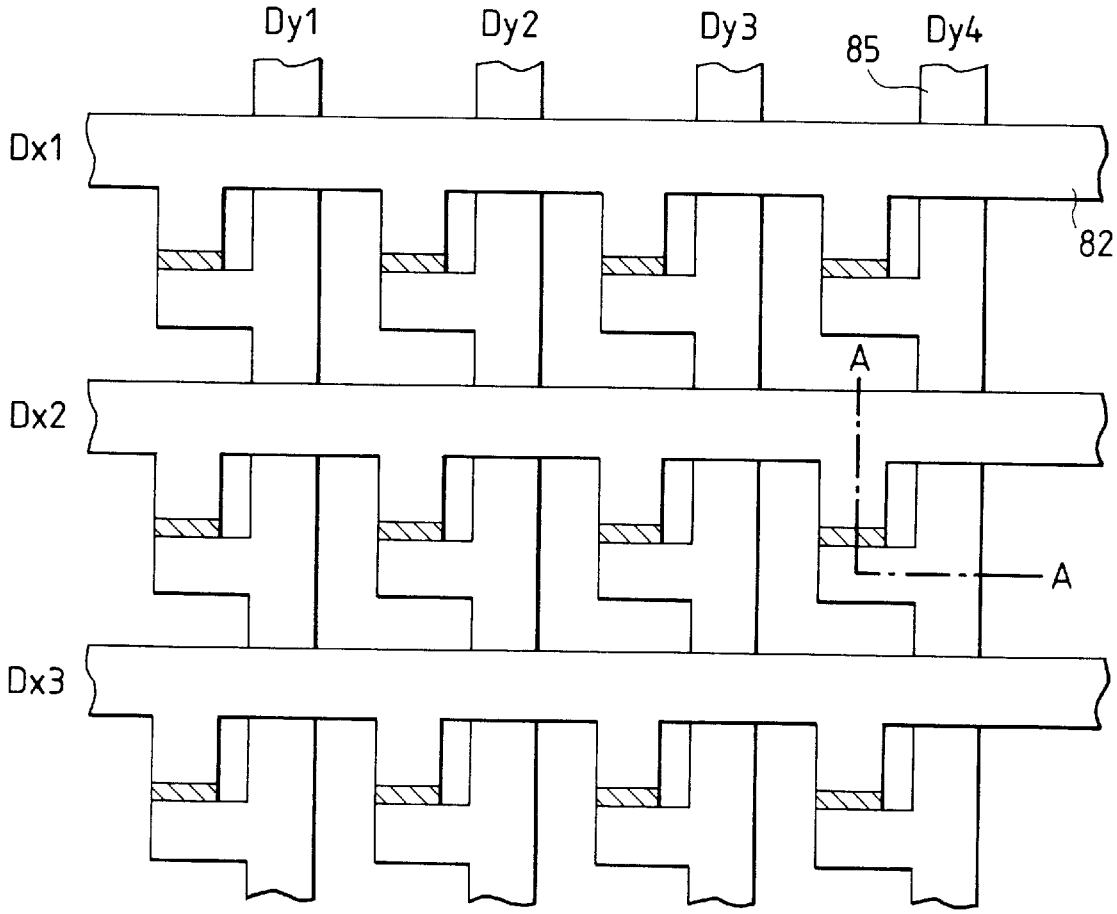
FIG. 12 is a plan view of the electron source of FIGS. 11A, 11B, 11C, 11D and 11E, which shows cross-sectional views taken along line A—A.

In this example, not only device electrodes but wires were also formed by photolithography. The procedures of preparing an image-forming apparatus in this example will be described by referring to FIGS. 11A through 11E and FIG. 12, of which FIG. 12 is a schematic plan view of the electron source of this example and FIGS. 11A through 11E are sectional views taken along line A—A in FIG. 12. Note that the interlayer insulation layer and the contact holes are omitted in FIG. 12.

(Step-a)

After thoroughly cleansing a soda lime glass plate, a silicon oxide film was formed thereon to a thickness of 0.5 μm by sputtering to produce a substrate 81. Then, a Cr film and an Au film were sequentially formed on the substrate to thicknesses of 5 nm and 600 nm respectively by vacuum evaporation, on which photoresist (AZ1370: available from Hoechst) was applied, while rotating the substrate, by means of a spinner and then baked. Thereafter, a photomask image was exposed and photochemically developed to produce a mask for Y-directional wires (lower wires) and then the Au/Cr depostion film was wet-etched to obtain Y-directional wires (lower wires) 82 having a desired pattern. (FIG. 11A)

(Step-b)

An interlayer insulation layer 83 of silicon oxide film was deposited to a thickness of 10 μm by RF sputtering. (FIG. 11B).

(Step-c)

Subsequently, a photoresist pattern was formed on the silicon oxide film for contact holes 84 to be produced through the deposited silicon oxide film in Step-b and, using the resist pattern as a mask, contact holes 84 were actually prepared by etching the interlayer insulation layer 83 by means of RIE (Reactive Ion Etching). $CF_4$ and $H_2$ were used as etching gas. (FIG. 1C)

(Step-d)

Thereafter, a pattern of photoresist (RD-2000N-41: available form Hitachi Chemical Co., Ltd.) was prepared for device electrodes 51 and 52 showing a gap L between the device electrodes and Ti and Ni were sequentially deposited to respective thicknesses of 5 nm and 100 nm by vacuum evaporation. Then, the photoresist pattern was dissolved into an organic solvent and the Ni/Ti deposition layers were lifted off to produce pairs of device electrodes 51 and 52, having a width of 300 μm and separated by a gap of 3 μm. (FIG. 1D)

(Step-e)

Then, a photoresist pattern was prepared for X-directional wires (upper wires) 85 on the device electrodes 51 and 52 and Ti and Au were sequentially deposited to respective thicknesses of 5 nm and 100 nm by vacuum evaporation. Then, any unnecessary areas of the photoresist were removed by means of a lift-off technique to produce upper wires 85. (FIG. 11E).

(Step-f)

Liquid drops were applied as in Step-e of Example 1-1 to produce precursor films. A solution of organic palladium (ccp-4230: available from Okuno Pharmaceutical Co., Ltd.) was used.

(Step-g)

Each of the precursor films was observed by means of a microscope. Any film that carried one or more than one large crystal, that had been displaced from the proper position, that had been deformed and did not show a proper circular form, or that had a diameter exceeding 48 μm or smaller than 32 μm, was determined to be unacceptable. Drops of butyl acetate were applied to the defective area by means of the ink-jet device, using the nozzle that had not been used in the Step-e above. The ink-jet device was so regulated for the discharge of the solution that each drop showed a volume of about 60 $\mu m^3$ and a total of ten drops were applied to each defective device to dissolve and dilute the defective precursor film in order to expand the film over the entire area surround by wires. Then, the solvent of butyl acetate was left for drying and thereafter heat-treated at 300° C. for 10 minutes. As a result of the heat-treatment, the precursor films of the acceptable devices turned to so many electroconductive films of PdO fine particles. The treated areas came to show high electric resistance.

(Step-h)

A precursor film was formed again on the area, from which the precursor film had been removed in the above step, under the conditions as described above for Step-f. The precursor film was observed through an microscope to confirm that it was acceptable this time. The precursor film produced for the second time in Example 1-1 showed a diameter that was acceptable, but slightly greater, than a precursor film that was accepted in the first examining step. This may be because the solution applied for the second time was apt to be expanded more than the solution applied for the first time, as a thin film of the organic palladium compound was already there. Contrary to this, the precursor film formed for the second time showed a contour substantially the same as the one formed for the first time. This may be because the dispersed organic palladium compound had turned to coagulated PdO particles to ensure a same level of wettability of the substrate both to the liquid drops applied for the first time and to the drops applied for the second time.

(Step-i)

Then, the precursor film was heat-treated at 300° C. for 10 minutes to produce an electroconductive film comprising fine particles of PdO.

The following steps were same as those of Example 1-1.

The produced image-forming apparatus operated excellently for displaying images without noticeable unevenness in the brightness as in the case of Example 1-1.

Example 3-2

In this example, the steps of Example 3-1 were followed to produce an image-forming apparatus except that a bubble-jet type ink-jet device was used to obtain a comparable result.

Example 4

In this example, the steps of Example 2 were followed except for the following.

The acceptable precursor films showed a diameter of 80 μm, i.e., were twice as large as that of their counterparts of Example 2. They showed a film thickness of 30 μm. If these films had been treated as in Example 2, no acceptable electroconductive films would have been produced from them because the average film thickness could not be small enough.

Liquid drops of a solvent were applied to the precursor films rejected in the examining step to dissolve and expand the films by means of a bubble-jet type ink-jet device. A 5 wt % aqueous solution of ammonium salt of ethylenediaminetetraacetate (EDTA) was used for the solvent. It contained ligands that were coordinated with Pd ions so that it could dissolve the precursor film more quickly than water.

After heat-treating the electron source at 300° C. for 10 minutes, the defective electron-emitting devices were locally exposed to a reducing atmosphere, maintaining the electron source to about 150° C., by means of a dual nozzle structure as described earlier by referring to FIG. 7. The reducing atmosphere contained a mixture gas prepared by diluting hydrogen gas $H_2$ with nitrogen gas $N_2$ to show a hydrogen concentration of 2%. Since the explosive lower limit of hydrogen gas concentration in air is 4%, the above mixture gas could be used without any special anti-explosion arrangement if the manufacturing facility was ventilated well.

As a result of the above process, the related PdO fine particles turned to Pd fine particles that subsequently coagulated to become large particles so that they did not show any electroconductivity globally.

All the remaining steps were same as those of Example 2.

The resulting image-forming apparatus operated excellently for displaying images without noticeable unevenness in the brightness as in the case of Example 2.

Example 5-1

In this example, Step-a through Step-e of Example 1-1 were followed except that the conditions were so selected in this example to produce precursor films having a diameter of 80 μm. Since the defective precursor films had a large diameter and could not be expanded sufficiently in this example by dissolving it with a solvent, the following step was required.

(Step-f)

Liquid drops of a 5 wt % aqueous solution of EDTA as used for Example 4 above were applied to the precursor films determined to be unacceptable through a microscopic observation and the solution containing the dissolved precursor films was sucked by pressing a rod provided with a piece of polyester sponge to each defective area.

The following steps were same as those of Example 1-1.

The resulting image-forming apparatus operated excellently for displaying images without noticeable unevenness in the brightness as in the case of Example 1-1.

Electron-emitting devices can be arranged highly densely with the procedures of this example to produce a high definition image-forming apparatus. The possibility of generating a leak current that can become significant if the defective precursor films were simply dissolved by a solvent can be eliminated by completely removing the defective precursor films.

Example 5-2

In this example, the steps of Example 5-1 were followed to produce an image-forming apparatus except that a bubble-jet type ink-jet device was used here to produce an image-forming apparatus as effective as its counterpart of Example 5-1.

Example 6-1

In this example, the steps of Example 5-1 were followed for the following.

Liquid drops of the solvent were applied to the precursor films determined as defective by an examining step as Step-f of Example 5-1 and thereafter the solution containing the dissolved precursor films was sucked by means of a syringe needle connected to an exhaust apparatus by way of a silicon tube.

While a relatively large manufacturing apparatus had to be used for this example if compared with Example 5-1 but the above arrangement was effective for continuous manufacturing operation without replacing the sponge and hence suitable for mass production.

The technique of this example can be applied to an electron source having a ladder-like wiring arrangement described in Example 1-2 to achieve a similar result.

Example 6-2

In this example, the steps of Example 6-1 were followed to produce an image-forming apparatus except that a bubble-jet type ink-jet device was used here to produce an image-forming apparatus as effective as its counterpart of Example 6-1.

Example 7

In this example, device electrodes were prepared by offset printing while wires were formed by screen printing.

(Step-a)

After thoroughly cleansing a soda lime glass plate, a silicon oxide ($SiO_2$) film was formed thereon to a thickness of 0.5 μm by sputtering to produce a substrate 1. Then, a pair of device electrodes 51 and 52 were formed for each electron-emitting device by offset printing using Pt resinate paste. The device electrodes were separated by a gap of 50 μm. (See FIG. 8A.)

Then, Step-b through Step-d of Example 1-1 were followed.

(Step-e)

Liquid drops of an aqueous solution of PAME as used in Step-e of Example 2 was applied to each electron-emitting device to produce a precursor film of an electroconductive film by means of a bubble-jet type ink-jet device. The conditions of this step were so selected as to produce circular precursor films having a diameter of 100 μm. Then, the precursor films were heat-treated at 300° C. for 10 minutes to produce electroconductive films of PdO fine particles.

(Step-f)

The electric resistance of each electron-emitting device was observed and those having a resistance deviating from a reference value by more than 20% were rejected.

A rod provided with a piece of silicon rubber having a diameter of 200 μm and a thickness of 500 μm was pressed against each defective electron-emitting device to cause the silicon rubber to suck the electroconductive film, which was then removed.

(Step-g)

An electroconductive film was formed as in Step-e to replace the removed electroconductive film.

The following steps were same as those of Example 1-1.

The resulting image-forming apparatus operated excellently for displaying images without noticeable unevenness in the brightness as in the case of Example 1-1.

Example 8

In this example, the steps of Example 7 were followed except the following.

Each of the electroconductive films determined as defective in Step-f of Example 7 was chemically reduced with the technique used in Example 4 and then the solution of the reduced substance was sucked and removed by using a silicon rubber in a manner as described in Example 7.

The effect of the chemical reduction is that the electroconductive film could reduce the adhesion to the glass substrate by reducing the PdO fine particles of the electroconductive film to metal Pd so that the film could be removed easily and surely by pressing the silicon rubber against it.

Example 9

After following Step-a through Step-e of Example 7, the following steps were conducted.

(Step-f)

An electron source substrate prepared by following Step-a through Step-e of Example 7 was placed in a vacuum chamber, which was then evacuated to a pressure level lower than $1.3\times10^{-4}$Pa. The exhaust system used here was an ultra-high vacuum system comprising an ion pump as main pump and a scroll pump as an auxiliary pump.

Then, the electron source was subjected to an energization forming process in a manner as described for Step-j of Example 1-1 to produce an electron-emitting region in each of the electroconductive films.

(Step-g)

Subsequently, acetone was introduced into the vacuum chamber to a pressure level of $1.3\times10^{-2}$Pa and the electron source was subjected to an activation process in a manner as described for Step-k of Example 1-1.

(Step-h)

The vacuum chamber was evacuated for 10 hours to a pressure level of less than $1.3\times10^{-6}$Pa, while heating it to about 200° C. Subsequently, a triangular pulse voltage with a wave height of 18V was applied sequentially to the electron-emitting devices to observe the device current If and the corresponding device voltage Vf of each device.

Most of the electron-emitting devices showed a non-linear If–Vf relationship having a threshold value close to 10V. The device current If of each device was very small below the threshold value. More specifically, If=1.4–1.7 mA for Vf=18V. However, some of the large number of electron-emitting devices prepared in a same way showed an ohmic effect, while others did not show any significant If for Vf=18V. Each of these devices was rejected as defective along with the devices that showed a value less than 1.2 mA for If at Vf=18V.

(Step-i)

The electron source was then taken out from the vacuum chamber and the electroconductive film of each of the defective electron-emitting devices was chemically reduced and removed as in Example 8 and the above steps were repeated to produce an electron source free from defective electron-emitting devices.

(Step-j)

An envelope was prepared as in Step-i of Example 1-1. Then, the envelope was evacuated and the exhaust pipe was welded before the envelope was subjected to a gettering process to produce an image-forming apparatus as in Step-l of Example 1-1.

The produced image-forming apparatus operated excellently for displaying images without noticeable unevenness in the brightness as in the case of Example 1-1.

Example 10

In this example, Step-a through Step-e of Example 7 and Step-f of Example 9 were followed. Thereafter, the following steps were conducted.

(Step-g)

After the above steps, a triangular pulse was applied sequentially to the electron-emitting devices to observe the device current If and the corresponding device voltage Vf of each device. The triangular pulse had a wave height of 12V.

A total of 100 pulses were applied to each device to obtain the average of the observed values in order to eliminate the effect of noise. Then, the quadratic differential of the If–Vf relationship was determined by calculation using the obtained data to find a peak value for Vf, which was then taken for the threshold voltage Vth. All the devices with Vth=10.0±1.0 were accepted whereas the remaining devices were rejected. While the devices were mostly acceptable, some of a large number of electron sources prepared in this example contained defective electron-emitting devices.

(Step-h)

The electron source was taken out from the vacuum chamber and each of the rejected electroconductive films was microscopically observed. Some of the rejected electroconductive films showed a large fissure for the electron-emitting region. An electron-emitting device with an electroconductive film having such a fissure did not show detectable If. The electron-emitting device of such a defective device was not removed and another electroconductive film was formed thereon.

Some of the remaining defective electron-emitting devices had a defective electron-emitting region and the electroconductive film was not completely separated into portions by a fissure to show a continuous electroconductive film, whereas others were carrying a foreign object adhering thereto or only a part of the electron-emitting region showed a large fissure. These defective electroconductive films were removed and replaced by new ones to produce a flawless electron source as in the case of Example 8.

(Step-i)

An envelope was prepared as in Step-k of Example 1-1. Then, acetone was introduced into the envelope for an activation process.

(Step-k)

The envelope was evacuated to show a high degree of vacuum and the exhaust pipe was welded before a gettering operation to produce an image-forming apparatus as in Step-l of Example 1-1.

The produced image-forming apparatus operated excellently for displaying images without noticeable unevenness in the brightness as in the case of Example 1-1.

Advantages of the Invention

As described above, according to the invention, in the process of manufacturing electron-emitting devices such as surface conduction electron-emitting devices, each comprising a pair of device electrodes and an electroconductive film including an electron-emitting region arranged between the device electrodes, any defective electroconductive films can be rectified or replaced by flawless devices to improve the manufacturing yield. Particularly, in the case of an electron source comprising a plurality of electron-emitting devices, some of the electron-emitting devices that are found to be defective can be locally rectified so that the operation of manufacturing image-forming apparatus comprising such electron sources can be conducted with a high yield to display fine images without noticeable unevenness in the brightness.

What is claimed is:

1. A method of manufacturing an electron-emitting device having an electroconductive film including an electron-emitting region arranged between a pair of device electrodes, characterized in that the process of forming an electroconductive film including an electron-emitting region comprises steps of applying a liquid containing precursor material of the electroconductive film to a substrate by an ink-jet method, thereafter detecting any defective area in the applied liquid, and thereafter reapplying the liquid containing the precursor material of the electroconductive film to any defective area by an ink-jet method and heat-treating the applied liquid to produce the electroconductive film, wherein said step of detecting any defective area in the applied liquid comprises a step of examining a precursor film of the electroconductive film formed by drying the applied liquid, and wherein said step of reapplying the liquid containing the precursor material is conducted after a step of applying a solvent of the precursor material to the precursor film detected to be defective in said step of examining the precursor film.

2. A method of manufacturing an electron-emitting device according to claim 1, wherein said solvent to be applied to the precursor film detected to be defective is a solvent containing a ligand which is chelatable with a component element of said precursor film.

3. A method of manufacturing an electron-emitting device according to claim 1, wherein said step of applying the solvent to the precursor film is performed by means of an ink-jet system.

4. A method of manufacturing an electron-emitting device having an electroconductive film including an electron-emitting region arranged between a pair of device electrodes, characterized in that the process of forming an electroconductive film including an electron-emitting region comprises steps of applying a liquid containing precursor material of the electroconductive film to a substrate by an ink-jet method, thereafter detecting any defective area in the applied liquid, and thereafter reapplying the liquid containing the precursor material of the electroconductive film to any defective area by an ink-jet method and heat-treating the applied liquid to produce the electroconductive film, wherein said step of detecting any defective area in the applied liquid comprises a step of examining a precursor film of the electroconductive film formed by drying the applied liquid, and wherein said step of reapplying the liquid containing the precursor material is conducted after steps of applying a solvent of the precursor material to the precursor film detected to be defective in said step of examining the precursor film, and heating the applied solvent.

5. A method of manufacturing an electron-emitting device according to claim 4, wherein the solvent to be applied to the precursor film detected to be defective is a solvent containing a ligand which is chelatable with a component element of said precursor film.

6. A method of manufacturing an electron-emitting device according to claim 4, wherein said step of applying the solvent to the precursor film is performed by means of an ink-jet system.

7. A method of manufacturing an electron-emitting device having an electroconductive film including an electron-emitting region arranged between a pair of device electrodes, characterized in that the process of forming an electroconductive film including an electron-emitting region comprises steps of applying a liquid containing precursor material of the electroconductive film to a substrate by an ink-jet method, thereafter detecting any defective area in the applied liquid, and thereafter reapplying the liquid containing the precursor material of the electroconductive film to any defective area by an ink-jet method and heat-treating the applied liquid to produce the electroconductive film, wherein said step of detecting any defective area in the applied liquid comprises a step of examining a precursor film of the electroconductive film formed by drying the applied liquid, and wherein said step of reapplying the liquid containing the precursor material is conducted after steps of applying a solvent of the precursor material to the precursor film detected to be defective in said step of examining the precursor film, heating the applied solvent, and thereafter exposing the applied and heated region to a reducing atmosphere.

8. A method of manufacturing an electron-emitting device according to claim 7, wherein the solvent to be applied to the precursor film detected to be defective is a solvent containing a ligand which is chelatable with a component element of said precursor film.

9. A method of manufacturing an electron-emitting device according to claim 7, wherein said application of the solvent to the precursor film is performed by means of an ink-jet system.

10. A method of manufacturing an electron-emitting device having an electroconductive film including an electron-emitting region arranged between a pair of device electrodes, characterized in that the process of forming an electroconductive film including an electron-emitting region comprises steps of applying a liquid containing precursor material of the electroconductive film to a substrate by an ink-jet method, thereafter detecting any defective area in the applied liquid, and thereafter reapplying the liquid containing the precursor material of the electroconductive film to any defective area by an ink-jet method and heat-treating the applied liquid to produce the electroconductive film, wherein said step of detecting any defective area in the applied liquid comprises a step of examining a precursor film of the electroconductive film formed by drying the applied liquid, and wherein said step of reapplying the liquid containing the precursor material is conducted after steps of applying a solvent of the precursor material to the precursor film detected to be defective in said step of examining the precursor film, and sucking the solvent.

11. A method of manufacturing an electron-emitting device according to claim 10, wherein the solvent to be applied to the precursor film detected to be defective is a solvent containing a ligand which is chelatable with a component element of said precursor film.

12. A method of manufacturing an electron-emitting device according to claim 10, wherein said step of applying the solvent to the precursor film is performed by means of an ink-jet system.

13. A method of manufacturing an electron-emitting device having an electroconductive film including an electron-emitting region arranged between a pair of device electrodes, characterized in that the process of forming an electroconductive film including an electron-emitting region comprises steps of applying a liquid containing precursor material of the electroconductive film to a substrate by an ink-jet method and thereafter detecting any defective area in the applied liquid and thereafter reapplying the liquid containing the precursor material of the electroconductive film to the defective area by an ink-jet method and heat-treating the applied liquid to produce the electroconductive film, wherein said step of detecting any defective area in the applied liquid comprises a step of examining the electroconductive film formed by drying and heating the applied liquid.

14. A method of manufacturing an electron-emitting device according to claim 13, wherein said step of examining the electroconductive film comprises a step of measuring the electric resistance of the electroconductive film.

15. A method of manufacturing an electron-emitting device according to claim 13, wherein said step of reapplying the liquid containing the precursor material is conducted after a step of removing the electroconductive film detected to be defective as a result of examination of the electroconductive film.

16. A method of manufacturing an electron-emitting device according to claim 15, wherein said step of removing the electroconductive film detected to be defective comprises a step of taking up the defective electroconductive film by means of an adhesive medium.

17. A method of manufacturing an electron-emitting device according to claim 13, wherein said step of reapplying the liquid containing the precursor material is conducted after a step of exposing the electroconductive film detected to be defective as a result of examining the electroconductive film to a reducing atmosphere and thereafter removing the electroconductive film.

18. A method of manufacturing an electron-emitting device according to claim 17, wherein said step of removing the electroconductive film detected to be defective comprises a step of taking up the defective electroconductive film by means of an adhesive medium.

19. A method of manufacturing an electron-emitting device having an electroconductive film including an electron-emitting region arranged between a pair of device electrodes, characterized in that the process of forming an electroconductive film including an electron-emitting region comprises steps of applying a liquid containing precursor material of the electroconductive film to a substrate by an ink-jet method and thereafter detecting any defective area in the applied liquid and thereafter reapplying the liquid containing the precursor material of the electroconductive film to the defective area by an ink-jet method and heat-treating the applied liquid to produce the electroconductive film, wherein said step of detecting any defective area in the applied liquid comprises a step of examining the electroconductive film including the electron-emitting region formed in the electroconductive film formed by drying and heating the applied liquid.

20. A method of manufacturing an electron-emitting device according to claim 19, wherein said step of examining said electroconductive film including said electron-emitting region comprises a step of observing the relationship between the voltage (Vf) applied to the electroconductive film including the electron-emitting region and the electric current (If) caused to flow by the applied voltage.

21. A method of manufacturing an electron-emitting device according to claim 19, wherein said step of examining said electroconductive film including said electron-emitting region comprises a step of observing the relationship between the voltage (Vf) applied to the electroconductive film including the electron-emitting region and the electric current (If) caused to flow by the applied voltage and determining by calculation the peak value of ($d^2If/dVf^2$) from said relationship between Vf and If.

22. A method of manufacturing an electron-emitting device according to claim 19, wherein said step of reapplying the liquid containing the precursor material is conducted after a step of exposing the electroconductive film detected to be defective as a result of examining the electroconductive film including the electron-emitting region to a reducing atmosphere and subsequently removing the electroconductive film.

23. A method of manufacturing an electron-emitting device according to claim 22, wherein said step of removing the electroconductive film including the electron-emitting region detected to be defective comprises a step of taking up the defective electroconductive film including the electron-emitting region by means of an adhesive medium.

24. A method of manufacturing an electron-emitting device according to any one of claims 1 through 23, wherein said ink-jet system is a system of ejecting liquid drops from a nozzle as a piezo-electric element arranged therein is deformed.

25. A method of manufacturing an electron-emitting device according to any one of claims 1 through 23, wherein said ink-jet system is a system of ejecting liquid drops from a nozzle by heating the liquid and causing it to bubble.

26. A method of manufacturing an electron source comprising a plurality of electron-emitting devices arranged on a substrate, each having an electroconductive film including an electron-emitting region and formed between a pair of device electrodes, characterized in that said electron-emitting devices are manufactured by a method according to any one of claims 1 through 23.

27. A method of manufacturing an electron source according to claim 26, wherein said ink-jet system is a system of ejecting liquid drops from a nozzle as a piezo-electric element arranged therein is deformed.

28. A method of manufacturing an electron source according to claim 26, herein said ink-jet system is a system of ejecting liquid drops from a nozzle by heating the liquid and causing it to bubble.

* * * * *

UNITED STATES PATENT AND TRADEMARK OFFICE

CERTIFICATE OF CORRECTION

PATENT NO. : 6,309,691 B1
DATED : October 30, 2001
INVENTOR(S) : Mitsutoshi Hasegawa It is certified that error appears in the above-identified patent and that said Letters Patent is hereby corrected as shown below:

Title page,
Item [56] References Cited, "7235255" should read -- 7-235255 --; and "8273529" should read -- 8-273529 --.

Column 1,
Line 18, "crystal" should read -- crystals --.

Column 2,
Line 18, "device" (first occurrence) should read -- device, --.

Column 3,
Line 10, "factors." (Close up right margin);
Line 11, "The" (Close up left margin); and
Line 31, "above described" should read -- above-described --.

Column 4,
Line 1, "an" (second occurrence) should read -- a --.

Column 5,
Line 24, "shows" should read -- show --.

Column 6,
Line 6, "above described" should read -- above-described --.

Figure 2B:
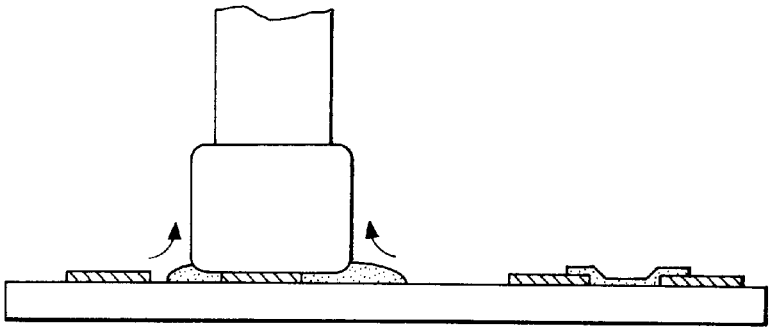
Figure 2C:
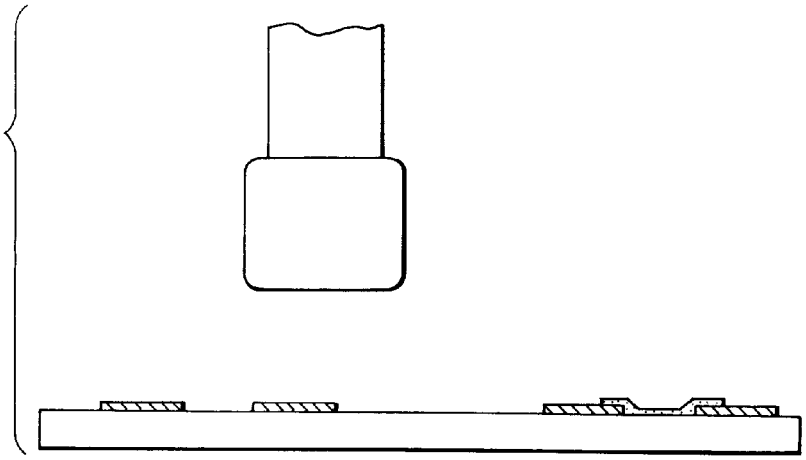

Column 8,
Line 1, "above described" should read -- above-described --;
Line 41, "FIG. 17" should read -- FIG. 2B --; and
Line 43, "FIG. 23" should read -- FIG. 2C. --.

Column 9,
Lines 11 and 14, "particle" should read -- particles --.

Column 10,
Line 37, "Additionally" (Close left margin); and
Line 62, "is" should read -- are --.

UNITED STATES PATENT AND TRADEMARK OFFICE

CERTIFICATE OF CORRECTION

PATENT NO. : 6,309,691 B1
DATED : October 30, 2001
INVENTOR(S) : Mitsutoshi Hasegawa It is certified that error appears in the above-identified patent and that said Letters Patent is hereby corrected as shown below:

Column 11,
Line 36, "consideration." (Close right margin); and
Line 37, "Organic" (Close left margin).

Column 13,
Line 9, "an" should read -- a --.

Figure 15:
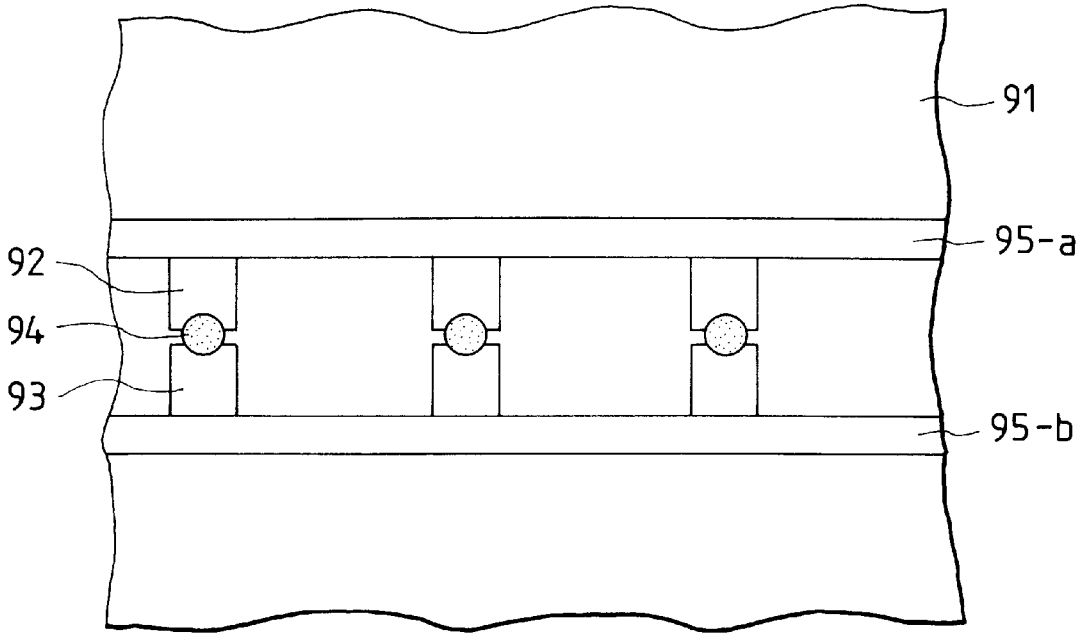
FIG. 15 is a schematic illustration of an electron source having a ladder-like wiring arrangement.
Figure 16:
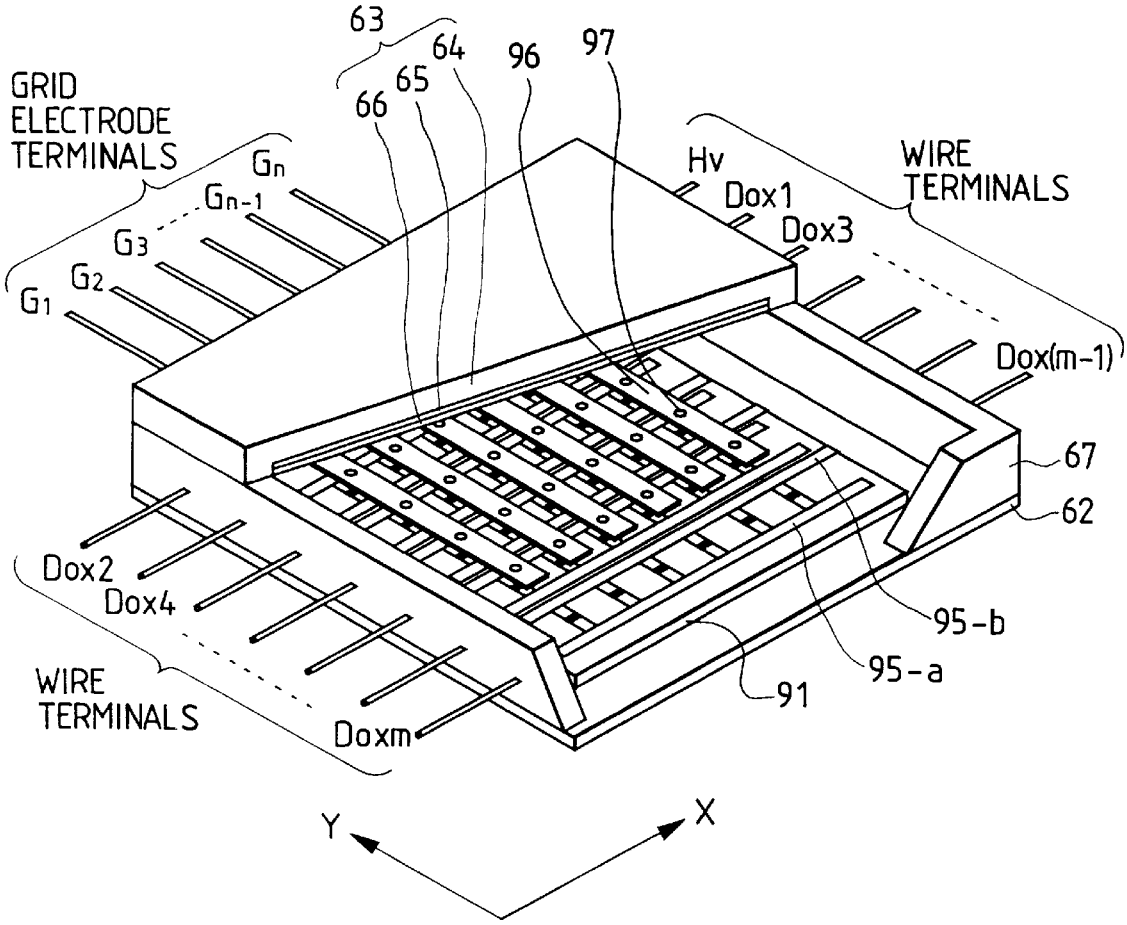
FIG. 16 is a schematic illustration of an image-forming apparatus comprising an electron source as illustrated in FIG. 15.

Column 14,
Line 13, "was" (first occurrence) should be deleted;
Line 43, "the" should be deleted;
Line 46, "same" should read -- the same --;
Line 50, "example," should read -- example, as shown in FIG. 15, --;
Line 52, "films" should read -- films 94 --; and
Line 54, "and" (second occurrence) should read -- and as shown in FIG. 16, --.

Column 15,
Line 8, "1 wt %." should read -- 2wt %. --; and
Line 61, "(FIG. 1C)" should read -- (FIG. 11C) --.

Column 16,
Line 4, "(FIG. 1D)" should read -- (FIG. 11D) --;
Line 40, "an" should read -- a --;
Line 59, "same" should read -- the same --; and
Line 62, "the" (first occurrence) should be deleted.

Column 17,
Lines 33 and 53, "same" should read -- the same --;
Line 36, "the" (first occurrence) should be deleted; and
Line 44, "it" should read -- them --.

Column 18,
Line 45, "was" should read -- were --; and
Line 64, "same" should read -- the same --.

UNITED STATES PATENT AND TRADEMARK OFFICE

CERTIFICATE OF CORRECTION

PATENT NO. : 6,309,691 B1
DATED : October 30, 2001
INVENTOR(S) : Mitsutoshi Hasegawa It is certified that error appears in the above-identified patent and that said Letters Patent is hereby corrected as shown below:

Column 19,
Line 3, "except" should read -- except for --.

Column 20,
Line 66, "the" should be deleted.

Signed and Sealed this

Fourteenth Day of May, 2002

*Attest:*

*Attesting Officer*

JAMES E. ROGAN
*Director of the United States Patent and Trademark Office*